US012054868B2

(12) United States Patent
Neely et al.

(10) Patent No.: US 12,054,868 B2
(45) Date of Patent: Aug. 6, 2024

(54) TUFTING MACHINE AND METHOD OF TUFTING

(71) Applicant: Card-Monroe Corp., Chattanooga, TN (US)

(72) Inventors: Marshall A. Neely, Soddy Daisy, TN (US); Ricky E. Mathews, Sale Creek, TN (US); William M. Christman, Jr., Chattanooga, TN (US)

(73) Assignee: Card-Monroe Corp., Chattanooga, TN (US)

( * ) Notice: Subject to any disclaimer, the term of this patent is extended or adjusted under 35 U.S.C. 154(b) by 112 days.

(21) Appl. No.: 17/843,011

(22) Filed: Jun. 17, 2022

(65) Prior Publication Data

US 2022/0403577 A1 Dec. 22, 2022

Related U.S. Application Data

(60) Provisional application No. 63/212,770, filed on Jun. 21, 2021.

(51) Int. Cl.
*D05C 15/26* (2006.01)
*D05C 15/10* (2006.01)
(Continued)

(52) U.S. Cl.
CPC ..... *D05C 15/26* (2013.01); *D05C 15/10* (2013.01); *D05C 15/145* (2013.01); *D05C 15/22* (2013.01); *D05C 15/24* (2013.01)

(58) Field of Classification Search
CPC . D05C 15/04; D05C 15/08–34; D05C 15/145
See application file for complete search history.

(56) References Cited

U.S. PATENT DOCUMENTS 2,842,080 A * 7/1958 Hoeselbarth ..... D05C 15/32 112/80.55
3,485,195 A 12/1969 Torrence
(Continued)

FOREIGN PATENT DOCUMENTS

CN 1946893 A 4/2007
CN 102535058 A 7/2012
(Continued)

OTHER PUBLICATIONS

Cobble; Spare Parts Manual ColorTec, dated May 8, 1998.
(Continued)

*Primary Examiner* — Ismael Izaguirre
(74) *Attorney, Agent, or Firm* — Womble Bond Dickinson (US) LLP

(57) ABSTRACT

A tufting machine for selectively forming tufts of yarns, including different color or type yarns, for forming patterned tufted articles such as carpets. A series of needles are reciprocated into and out of a backing material being fed through the tufting machine and are engaged by a series of gauge parts so as to pick-up loops of yarns from the needles. The gauge parts will be selectively controlled by actuators to extend or retract the gauge parts to positions or elevations sufficient to pick-up or not pick-up loops of yarns from the needles. The feeding of the yarns to the needles further can be controlled in conjunction with the movement of the gauge parts, while the backing feed can also be controlled, to enable formation of tufts of yarns at an increased rate over the pattern stitch rate for the pattern of the tufted article being formed.

36 Claims, 16 Drawing Sheets

(51) Int. Cl.

| | |
|---|---|
| ***D05C 15/14*** | (2006.01) |
| ***D05C 15/22*** | (2006.01) |
| ***D05C 15/24*** | (2006.01) |

(56) References Cited

U.S. PATENT DOCUMENTS

| | | | | |
|---|---|---|---|---|
| 3,978,800 | A | 9/1976 | Card et al. | |
| 4,138,956 | A | 2/1979 | Parsons | |
| 4,303,024 | A | 12/1981 | Bardsley | |
| 4,313,388 | A | 2/1982 | Biggs et al. | |
| 4,353,317 | A | 10/1982 | Crumbliss | |
| 4,354,441 | A | 10/1982 | Hurst | |
| 4,366,761 | A | 1/1983 | Card | |
| 4,369,720 | A | 1/1983 | Beasley | |
| 4,384,538 | A | 5/1983 | Slattery | |
| 4,397,249 | A | 8/1983 | Slattery | |
| 4,466,366 | A | 8/1984 | Hirotsu | |
| 4,483,261 | A | 11/1984 | Green et al. | |
| 4,487,140 | A | 12/1984 | Inman | |
| 4,491,078 | A | 1/1985 | Ingram | |
| 4,501,212 | A | 2/1985 | Slattery | |
| 4,509,439 | A | 4/1985 | Densmore et al. | |
| 4,528,921 | A | 7/1985 | Slattery | |
| 4,630,558 | A | 12/1986 | Card et al. | |
| 4,658,739 | A | 4/1987 | Watkins | |
| 4,739,717 | A | 4/1988 | Bardsley | |
| 4,815,403 | A | 3/1989 | Card et al. | |
| 4,836,118 | A | 6/1989 | Card et al. | |
| 4,840,133 | A | 6/1989 | Watkins | |
| 4,903,625 | A | 2/1990 | Card et al. | |
| 5,143,003 | A | 9/1992 | Dedmon | |
| 5,189,966 | A | 3/1993 | Satterfield | |
| 5,295,450 | A | 3/1994 | Neely | |
| 5,400,727 | A | 3/1995 | Neely | |
| 5,509,364 | A | 4/1996 | Bardsley | |
| 5,896,821 | A | 4/1999 | Neely et al. | |
| 5,954,003 | A | 9/1999 | Beyer et al. | |
| 6,116,173 | A | 9/2000 | Beyer | |
| RE37,108 | E | 3/2001 | Neely | |
| 6,244,203 | B1 | 6/2001 | Morgante et al. | |
| 6,651,571 | B2 | 11/2003 | Bennett et al. | |
| 7,107,918 | B2 | 9/2006 | Caylor et al. | |
| 7,191,717 | B2 | 3/2007 | Green et al. | |
| 7,222,576 | B2 | 5/2007 | Kilgore | |
| 7,237,497 | B2 | 7/2007 | Johnston | |
| 7,284,492 | B2 | 10/2007 | Johnston | |
| 7,347,151 | B1 | 3/2008 | Johnston et al. | |
| 7,398,739 | B2 | 7/2008 | Johnston | |
| 7,490,566 | B2 | 2/2009 | Hall | |
| 7,597,057 | B2 | 10/2009 | Johnston et al. | |
| 7,997,219 | B2 | 8/2011 | Jackson | |
| 8,141,505 | B2 | 3/2012 | Hall et al. | |
| 8,240,263 | B1 | 8/2012 | Frost et al. | |
| 8,359,989 | B2 | 1/2013 | Hall et al. | |
| 8,776,703 | B2 | 7/2014 | Hall et al. | |
| 9,410,276 | B2 | 8/2016 | Hall et al. | |
| 9,556,548 | B2 | 1/2017 | Frost et al. | |
| 9,593,437 | B2 | 3/2017 | Mathews | |
| 9,677,210 | B2 | 6/2017 | Hall et al. | |
| 9,708,739 | B2 | 7/2017 | Hall | |
| 10,233,578 | B2 | 3/2019 | Hall | |
| 10,280,541 | B2 | 5/2019 | Mathews | |
| 10,415,169 | B2 | 9/2019 | Hall et al. | |
| 10,443,173 | B2 | 10/2019 | Hall et al. | |
| 10,626,551 | B2 | 4/2020 | Hall | |
| 10,781,546 | B2 | 9/2020 | Mathews | |
| 10,995,440 | B2 | 5/2021 | Hall et al. | |
| 10,995,442 | B2 | 5/2021 | Hall | |
| 11,041,265 | B2 | 6/2021 | Mathews | |
| 11,136,702 | B2 | 10/2021 | Hall | |
| 11,193,225 | B2 | 12/2021 | Hall et al. | |
| 11,214,921 | B2 | 1/2022 | Hall | |
| 2003/0131771 | A1 | 7/2003 | Green | |
| 2008/0264315 | A1 | 10/2008 | Neely | |
| 2009/0260554 | A1 | 10/2009 | Hall et al. | |
| 2014/0261121 | A1 | 9/2014 | Woodall et al. | |
| 2014/0031192 | A1 | 10/2014 | Hall et al. | |
| 2017/0268144 | A1* | 9/2017 | Hall | D05C 15/34 |
| 2018/0171546 | A1 | 6/2018 | Hall | |
| 2018/0266027 | A1* | 9/2018 | Mathews | D05C 15/30 |
| 2019/0203394 | A1* | 7/2019 | Hall | D05C 15/10 |
| 2019/0338453 | A1* | 11/2019 | Hall | D05C 15/10 |
| 2020/0318273 | A1* | 10/2020 | Detty | D05C 15/22 |
| 2021/0246589 | A1 | 8/2021 | Hall | |

FOREIGN PATENT DOCUMENTS

| | | | |
|---|---|---|---|
| EP | 1645659 | A1 | 4/2006 |
| GB | 1335906 | | 10/1973 |
| GB | 2076441 | | 12/1981 |
| GB | 2295161 | | 5/1996 |
| JP | 1-221563 | | 9/1989 |
| JP | 2014/043661 | A | 3/2014 |
| KR | 10-2004-0056009 | A | 6/2004 |
| WO | WO 90/06391 | A1 | 6/1990 |
| WO | WO 94/28225 | A1 | 12/1994 |
| WO | WO 2008/134293 | A1 | 11/2008 |
| WO | WO 2009/023512 | A1 | 2/2009 |
| WO | WO2017/161110 | A1 | 9/2017 |

OTHER PUBLICATIONS

International Search Report and the Written Opinion of the International Searching Authority for PCT/US2022/034025 mailed Oct. 13, 2022.

* cited by examiner

TUFTING MACHINE AND METHOD OF TUFTING

CROSS-REFERENCE TO RELATED APPLICATION

The present application claims benefit of U.S. Provisional Patent Application No. 63/212,770, filed Jun. 21, 2021.

INCORPORATED BY REFERENCE

The disclosure of U.S. Provisional Patent Application No. 63/212,770, filed Jun. 21, 2021, is incorporated by reference herein for all purposes as if set forth in its entirety.

TECHNICAL FIELD

The present disclosure generally relates to tufting machines and methods of forming tufted fabrics. In particular, the present disclosure relates to tufting machines including selectively controllable gauge parts, as well as methods of forming patterned tufted fabrics.

BACKGROUND

In the tufting field, particularly with regard to commercial and hospitality carpets, there has been increased demand for the production of carpets and rugs with new visual patterns, including the use of multiple different colors, in an effort to keep up with changing consumer tastes and increased competition in the marketplace. Carpet designers and manufacturers thus have placed increased emphasis on the creation of newer, different and more eye-catching patterns for carpets, rugs and other tufted fabrics, including patterns having the selective placement and display of yarns of particular colors or types within pattern fields thereof, and with the resultant tufted fabrics being formed with a substantially true pattern density of the visible tufts of the pattern. It further has been desirable to try to replicate as closely as possible the look and feel of patterned carpets, rugs or other fabrics formed on a loom, but which can be created and formed therein on broadloom tufting machines so as to enable increased efficiencies in production of such patterned tufted carpets, rugs and/or other fabrics. In addition, there generally is a desire to provide increased control of the formation of tufts of selected colors or types of yarns for formation of patterned carpets, without substantially affecting the operation of tufting machines, including increasing the need for maintenance or placement of parts such as gauge parts thereof, or the output of such tufting machines.

Accordingly, it can be seen that a need exists for a system and method of forming tufted fabrics such as carpets and rugs that addresses these and other related and unrelated problems in the art.

SUMMARY OF THE PRESENT DISCLOSURE

Briefly described, the present disclosure generally relates to a tufting machine and method of forming patterned tufted articles in which the placement and the pile height of tufts of yarns or stitches formed in a backing can be selectively controlled so as to enable formation of patterned tufted articles, such as carpets, having a variety of pattern effects, including the formation of tufted articles with free-flowing multi-color and/or multi-pile height patterns, as well as having substantially woven or loom formed appearances.

In one aspect, the tufting machine typically will include a control system for controlling the operative elements of the tufting machine to form or create tufted articles according to desired or designed patterns. The resultant tufted articles can include various pattern effects, including having multiple, varied or different pile heights, different types of tufts in the same and/or varying tuft rows, and other textured effects, as well as the placement of various color and/or type yarns to be visible at selected locations and pile heights across the backing; with, at least in some embodiments, the resultant tufted articles being provided with a density of retained and/or visible color yarns/stitches per inch that substantially matches a desired or prescribed pattern density or stitches per inch for the pattern being formed/tufted.

In embodiments, the tufting machine will include one or more needle bars having a series of needles mounted therealong. The needles can be arranged in in-line, staggered or other arrangements. As a backing material is fed through a tufting zone of the tufting machine, yarns will be introduced therein as the needles are reciprocated into and out of the backing material. A shift mechanism further can be provided for shifting the needle bar(s) transversely across the tufting zone, and multiple shift mechanisms can be utilized as needed. The shift mechanism(s) generally will be operable in response to instructions or communications from the control system, for stepping or shifting the needle bar(s) transversely across the backing in accordance with programmed and/or designed pattern shift steps for a pattern being tufted to present the yarns carried thereby to tuft or stitch locations along/across the backing.

The tufting machine further generally will include at least one yarn feed mechanism or attachment for controlling the feeding of the yarns to their respective needles. Such a yarn feed mechanism or pattern attachment can include, without limitation, various roll, scroll, servo-scroll, single end, double or multiple end yarn feed attachments, such as, for example, a Yarntronics™ or Infinity™/Infinity IIE™ yarn feed attachment as manufactured by Card-Monroe Corp. Other types of yarn feed control mechanisms also can be used. The control system generally will include programming for control of the at least one yarn feed mechanism or pattern attachment, which can be operated to selectively control feeding of yarns to their needles for forming tufts of yarns, which can include forming tufts having selected pile heights and/or forming no tufts, to create the desired pattern appearance.

In some embodiments, the control system can further comprise or operate with a stitch distribution control system; through which control of the backing feed and control of the operation of the shift mechanism(s) for shifting of at least a portion of the needles can be coordinated with control of the at least one yarn feed mechanism such that various yarns can be presented to various stitch locations or pixels, and the yarns to be shown on the face or surface of the tufted article generally can be fed in amounts sufficient to form tufts of desired heights while the non-appearing yarns, which are not to be shown in the tufted field generally will not be picked-up when the gauge part is lowered to a no-sew position. Thus, for each pixel or stitch location of the pattern, a series of yarns can be presented, and pick-up of the yarns not selected to be visible or appearing at such a stitch location can be avoided when the gauge parts are in a no-sew position. In addition, in some embodiments, the yarn feed also can be controlled to include withdrawing or pulling some yarns lower, to form sculptured or varying pile height effects, and/or lengthening loops of yarns picked up by movement of the gauge parts in conjunction with the yarn feed control. In addition, some yarns can be pulled back or low out to a level or extent so as to leave a sufficient portion of a non-appearing within the backing to hold or tack the non-selected or non-appearing yarns to the backing without interference with the face or retained, visible tufts of yarns of the pattern by such non-appearing yarns substantially minimized. Thus, in embodiments, only desired or selected yarns/colors to be placed at a particular stitch location may be retained at such stitch location, and can form tufts or different pile heights and colors; while the remaining yarns/colors can be removed or pulled back to an extent that they can be tacked or held to the backing, but will not appear or show in the pattern fields being sewn at that time. The control system further can control and coordinate operation of one or more selected gauge part assemblies with the yarn feed mechanism(s) of the tufting machine according to the instructions for the pattern being formed to control selective formation of loops and/or tufts of yarns, and the lengths or pile heights thereof.

In addition, a gauge part assembly is located below the backing material. The gauge part assembly generally will comprise a series of gauge parts, including, for example and without limitation, loopers, hooks, level cut loop loopers, cut/loop clips, etc. The gauge parts will be positioned along the tufting zone, and are moveable in a first direction so as to be reciprocated into engagement with the needles as the needles penetrate the backing material to pick loops of yarns therefrom. In some embodiments, the gauge parts further each can be selectively movable in a second or additional direction that is generally normal to their direction of reciprocation. For example, the gauge parts can be moved in a substantially vertical, e.g., up-and-down, motion with respect to the stroke or reciprocation of the needles onto and out of the backing, as well as being moved in a reciprocating motion toward and away from the needles, to selectively pick up and form loops of yarns in the backing material. In addition, the movement of the gauge parts in their second direction (e.g. in a vertical or other direction) can be controlled so as to form varying length loops of yarns of varying pile heights in the backing material, including formation of different pile height loops or even no loops of yarns in the backing. In still further embodiments, other configurations and/or combinations of loop pile loopers, cut pile hooks, cut/loop hooks, level cut loopers or hooks, and/or other gauge parts also can be used.

In some embodiments, the gauge parts can include loopers or hooks, each with a body slidably mounted within a gauge module or gauge block, and having a first portion and a second portion, which can include an elongated throat terminating at a pointed proximal end or bill. The first portion of the body of each gauge part can extend through the gauge block or module and can be coupled at a distal end to a drive system including a plurality of actuators that each can be selectively actuated to control movement of the gauge parts in their second direction, and which will be coupled to an associated or corresponding one of the gauge parts by a connector assembly.

In some embodiments, the gauge modules each can include a module or block body having a first of rearward section adapted to couple or mount along a gauge bar, and a second or forward section having at least one channel or passage formed therethrough, and through which the gauge parts will be received. The modules further can include replaceable inserts that can be received within the passage or channel formed within the module body, the replaceable inserts further including slots or recesses adapted to receive and guide the gauge parts during movement of the gauge parts through/along the passage of the module block. Alternatively, the inserts could be integrated with the modules, such as by being bonded or otherwise substantially permanently affixed or secured to the bodies of their modules or gauge blocks, and in some embodiments, can be substantially affixed while still enabling at least serviceable removal thereof if needed.

In embodiments, the replaceable inserts will be formed from hardened materials that can include, without limitation, various metal carbides, metals, ceramics and/or synthetic materials, while the body of the module can be manufactured from lighter weight materials such as aluminum and/or other metals, as well as various composites or synthetic materials. The inserts further can include openings or slots configured to receive guide pins or other locating devices, as well as one or more fasteners, for securing the inserts in the gauge modules. The openings further generally will be configured to enable adjustment of the inserts in at least one direction, e.g., longitudinally, and/or in multiple directions e.g., longitudinally and/or laterally, for adjusting a position of the inserts, and thus the arrangement or positioning of the gauge parts across and/or along their gauge modules. The inserts further can be interchangeable so as to enable easy removal of the inserts, and thus the replacement of one or more of the gauge parts received therein, for example to replace a worn or broken gauge part, or for changing a spacing between the gauge parts.

As a further alternative, in some embodiments, the modules or gauge blocks themselves can be removed and can be replaceable with other gauge blocks or modules, each including a set or series of gauge parts mounted therein, such as to provide for a change out of gauge spacing between gauge parts, a change out of the type of size gauge parts being used, or for a replacement of substantially all or at least a large portion of worn or broken gauge parts as a unit. In addition, the guide slots or recesses formed within the inserts generally will be configured to receive the bodies of the gauge parts with a clearance that is generally sufficient to enable substantially free sliding movement of the gauge parts therethrough, but without enabling undue shifting or twisting of the gauge parts so as to create a misalignment of the bills or throats of the gauge parts with their respective needles. The slots or recesses of the inserts further can terminate at a rear end or portion that can be configured or adapted to enable the edges of the bodies of the gauge parts to be seated against and/or provided with a base or engagement area along which they can slide so as to help maintain a desired alignment of the gauge parts as they are reciprocated or moved through their modules.

The gauge parts additionally can be arranged so as to engage the needles, including being arranged in a substantially in-line, offset or staggered, and/or other configurations as needed to engage in-line, staggered and/or dual needle bar arrangements. In embodiments, each of the gauge parts further can be arranged at an angle with respect to the needles as the needles penetrate the backing. For example, in some embodiments, the gauge parts can be arranged and/or be extensible/retractable along a path of travel oriented at an angle that can range from approximately 1° to approximately 10° from the vertical with respect to the needles and/or the stroke or vertical motion thereof, while in other arrangements, no offset, i.e., a 0° angle, can be provided. The offset of the gauge parts with respect to the needles further can be varied so that the gauge parts can be extended and retracted along an angled or offset path of travel with respect to the needles as needed to minimize potential engagement with the needles as the gauge parts are moved, depending upon the spacing and/or arrangement of the needles.

In various embodiments, the drive system will include a series of selectively controllable actuators driving movement of the gauge parts, which actuators can comprise electric cylinders, hydraulic or pneumatic cylinders, solenoids, motors such as stepper motors, servo motors or other motors, linear actuators, moving coil or voice coil actuators, as well as other, similar actuators, and/or combinations thereof. The actuators associated with or corresponding to each of the gauge parts further can be selectively controlled in accordance with pattern instructions so as to cause the gauge parts to be moved to a desired vertical position with respect to associated needles for pickup of loops of yarns from the needles, including picking up loops of yarns at different points of the needles' stroke so as to form loops/tufts of different pile heights, as well as being retracted to a "no-sew" position wherein a loop of yarn of a selected type or color generally will not be picked up by such gauge parts.

For example, the actuators can be connected to associated or corresponding ones of the gauge parts by connector assemblies for selectively driving movement of such gauge parts in a second direction with respect to the needles as the gauge parts are reciprocated in their first direction toward and away from engagement with the needles. The control system further can include programming to selectively engage each actuator to control the movement of the gauge parts for forming tufts of yarns in accordance with the pattern being run by the tufting machine, including moving the gauge parts to form or not form tufts, and/or for formation of tufts of varying pile heights.

In further embodiments, the actuators can be controlled/triggered to move their gauge parts with a loop of yarn captured thereon so as to elongate or pull such captured loop(s) to provide other pile heights and/or for other effects, such as for tip shearing or other pattern or textured effects. For example, the gauge parts can engage and pick-up loops of yarns from selected needles, and thereafter can be moved, e.g. retracted, to a lowered position, with the feeding of the yarns for such loops also being controlled, so as to draw or pull the loops to a lowered or extended length position to create varying pile height effects. The movement of the gauge parts to a raised or extended position with loops of yarns captured thereon also can be controlled by the control system, with the yarn feed for such loops of yarns further being controlled to pull back such yarns to maintain tension therein and/or to form various pattern pile height effects.

In another aspect of the tufting machine and method of forming patterned tufted articles, the gauge parts can be configured to move or pivot between raised, operative positions, including a fully raised, first operative position, and a lowered, no-sew position, with a distal end or tip of the gauge parts generally being oriented and/or arranged below a penetration depth or stroke of the needles, typically below the pick-up points or take-off areas of the needles, and potentially below the tips of the needles. The gauge parts can comprise loopers, hooks, level cut loop loopers, or other gauge parts, with a body pivotally mounted to a support or holder, and with a throat projecting forwardly from the body and terminating at the generally pointed tip or distal end. The actuators corresponding to such gauge parts can be selectively engaged or operated so as to cause the body of their corresponding or associated gauge part to be pivoted for moving the throats and distal ends of the gauge parts to a desired lowered elevation with respect to the needles.

In various aspects, the gauge parts are coupled to their respective or corresponding actuators of the drive system by connector assemblies including connectors or gates configured to extend between an actuator shaft or rod and the distal end of an associated or corresponding gauge part. In some embodiments, the connectors or gates can include an arm or linkage having a first end portion configured to engage or connect to the drive rod of its actuator, an intermediate section projecting from the first end portion, and a second end portion that generally will be configured to engage the distal end of an associated gauge part. In embodiments, the linkage or arm of each of the connectors or gates further can be received within a housing or support structure. In one example embodiment, such a housing or support structure can include a body formed from a durable, lightweight material, such as a carbon filled nylon material or other, similar composite or plastic material selected to provide durability and support for the linkage or arm while enabling a reduction in weight. Other materials including various metals, synthetic and/or composite materials also can be used. The configurations of the gates and the housings thereof further can be varied as needed.

As each actuator is activated or deactivated, it extends or retracts an actuator shaft to cause the connector or gate coupled thereto move its associated or corresponding gauge part in a desired direction with respect to the needles. For example, in some embodiments, the actuators can drive the gauge parts in a substantially vertical direction with respect to a directional reciprocation of the needles into and out of the backing, such as for adjusting a height of the gauge parts with respect to the needles as the gauge parts are reciprocated toward and away from the needles. In other embodiments, the actuation of the actuators and movement of the connectors can help control movement of the gauge parts, or portions thereof, such controlling movement of clips of level cut loop loopers, toward and away from the needles in a direction substantially along the direction of reciprocation of the gauge parts toward and away from the needles.

In still other aspects, the gauge parts are coupled to associated or corresponding actuators of the drive system by connector assemblies that each include a gate or connector comprising a body having a first end along which the first portion of the body of a corresponding gauge part is received, and a second end. In some configurations, a series of biasing members can be located between the second end of each gate and a spring plate. One or more linkages, which can include arms, rods, cables, or other, similar members, can extend between the actuators and the connectors or gates; and in some embodiments, can be coupled to the gauge parts.

Each linkage generally can have a first end portion extending through the spring plate and adapted to connect to the second end of its corresponding gate, or to a gauge part, and a second end portion coupled to a corresponding or associated actuator. In embodiments, the linkages will extend along a path from the actuators to their corresponding or associated gauge parts/gates. In some embodiments, the linkages further can extend through guides. In such embodiments, the guides can be configured to adjust the pulling force applied by the actuators.

Upon actuation, each selected actuator moves the linkage connected thereto, for example, by pulling or retracting the linkage so as to cause the gate and/or the corresponding gauge part to be moved in its second direction toward a retracted positon and against the biasing force of one or more of the biasing members, generally compressing the biasing members as the gauge part is moved toward its retracted position. Upon deactivation of the actuator, the linkage can be released such that the one or more biasing members can decompress and/or bias or urge the corresponding gauge part toward its fully extended position. In embodiments, the biasing members can assist in control of the movement of the gauge parts in their second direction with respect to the needles to enable a substantially incremental movement and location of the gauge parts at varying positions of elevations. Such positional variations can be used to create or vary the lengths of the loops of yarns picked-up by the gauge parts and thus enable variations on pile heights of the tufts of yarns formed in the backing, as well as movement to a no-sew position where the gauge parts are moved to a positon where they will not engage the yarns being carried by the needles.

In other embodiments, the connector assemblies can include linkages coupled to the body of one of the gauge parts and to a corresponding or associated actuator. For example, the actuators can comprise motors and the linkages comprise cables, rods, arms of combinations thereof. In embodiments, the motors also can include drive members, which, in embodiments, can include an eccentric, cam, or a pulley or similar drive member configured to translate a rotary motion to linear motion. As the drive member is rotated by its actuator, the linkage is caused to be extended or retracted, which in turn drives the motion of the corresponding or associated gauge part in the second direction between its extended and retracted positions, including moving the gauge part to a no-sew position.

In some embodiments, the connector assemblies can include linkages comprising a first arm or rod having a first end coupled to a drive member, such as an eccentric or pulley, coupled to and drive by an associated one of the actuators, and a second end coupled to a second arm or rod at a first end thereof. The second arm can have a second end pivotally connected to the first portion of the body of its corresponding gauge part. As each drive member is rotated by its motor, the first arm is extended and retracted along a first axis of movement, causing the second arm to pivot and move the corresponding gauge part along a second axis of movement between its extended and retracted positions.

In still further embodiments, each connector assembly can include a linkage that can comprise or can be connected to an extension piece connected to or integrated with the body of a corresponding gauge part. The opposite end of the linkage can be coupled to an actuator, for example, being coupled to drive member (e.g. an eccentric or pulley) driven by a motor. As the motor rotates its drive member, the linkage can be extended or retracted to move the corresponding or associated gauge part between its extended and retracted positions.

In some aspects of the present disclosure, a tufting machine is provided, comprising at least one needle bar having needles mounted therealong; backing feed rolls feeding a backing material; at least one yarn feed mechanism; at least one yarn feed mechanism feeding yarns to the needles; a gauge part assembly positioned below the backing material and having a plurality of gauge parts moveable in a first direction toward and away from the needles as the needles are reciprocated into and out of the backing, and in a second direction; and a control system including programming for controlling the at least one yarn feed mechanism to control feeding of the yarns to the needles in coordination with control or actuation of one or more actuators linked to the gauge parts so as to cause retraction or extension of selected ones of the gauge parts so that the throats of the selected ones of gauge parts are moved between a fully retracted no-sew position and a fully extended position with respect to the stroke of the needles into the backing material, for engaging the needles and forming tufts of yarns in the backing material according to a pattern being formed.

In some embodiments, the gauge part assembly can comprise at least one module carrying a series of gauge parts in a reciprocating motion in a direction toward and away from engagement with the needles as the needles are reciprocated into the backing material; wherein the at least one module comprises a module body that can be machined, cast, molded or otherwise formed from a metal, polymer, composite or synthetic material, or combinations thereof, and will have a first hardness, The module body will be adapted to mount along a gauge bar and will be configured with a passage defined therethrough. Inserts will be mounted to the module body on opposite sides of the passage, each insert having a series of spaced slots formed therein, the slots each configured to slideably receive at least a portion of one of the gauge parts therein. In embodiments, the inserts can be machined, cast, molded or otherwise formed from a metal or metal carbide or powdered metal material having a second or additional hardness greater than the first hardness of module body, and with the slots formed or defined therein.

In some embodiments, the modules can include a module body and one or more inserts In embodiments, the gauge parts can each include a body at least partially received within opposed slots of the inserts and moveable through the passage of the module body in an additional direction with respect to a stroke of said needles, the body of each gauge part having a first portion extending through the passage of the at least one module and a second portion having a throat configured to pick-up loops of yarns from the needles.

In embodiments, a series of actuators are coupled to said gauge parts for controlling movement of the gauge parts though the module body; and a control system including programming for controlling the at least one yarn feed mechanism to control feeding of the yarns to the needles in coordination with control of the actuation of one or more of said actuators so as to extend or retract selected ones of the gauge parts such that said throats of the selected ones of gauge parts are moved between a no-sew position and an engaging position with respect to the stroke of said needles into the backing material for selectively forming tufts of yarns in the backing material according to a pattern being formed.

In various embodiments of tufting machine, the gauge parts comprise level cut loop loopers, loop pile loopers, cut pile hooks, or cut/loop clips, and/or combinations thereof. In still further embodiments, of the tufting machine the actuators can comprise hydraulic or pneumatic cylinders, solenoids, motors such as stepper motors, servo motors or other motors, linear actuators, moving coil or voice coil actuators, as well as other, similar actuators, and/or combinations thereof.

In still other embodiments of the tufting machine the gauge part assembly further can comprise a series of connectors extending between each gauge part and an associated actuator, each of the connectors including a linkage received within and movable through a housing. In some embodiments, the housing of each connector will comprise a body that can be formed from a polymer, composite or synthetic material or combination thereof and having a channel extending therethrough; and wherein each linkage comprises a metal or composite material or combinations thereof.

In other embodiments, the body of each housing can comprise a composite material including a polymer or plastic with a fibrous fill material, and has a channel defined therein and along which the linkage is moveable; and wherein the linkage of each connector can comprise a hardened metal body or arm, or a series of arms, extending along a passage defined through the body of the housing, with a proximal end configured to engage the first portion of one of the gauge parts, and a distal end configured to be engaged by the actuator associated with the gauge part for translating movement by the actuator to the gauge part.

In addition, in embodiments, the inserts of the modules generally will be configured to overlap an upper surface of the module body and each include a slotted opening adapted to receive a fastener therethrough for adjustably mounting each of the first and second inserts to the module body with the inserts arranged at a selected spacing from each other and at a selected location with respect to the passage defined through the module body. In addition, the inserts can be molded or encased, encapsulated, or otherwise substantially integrated within the module body. The inserts also can include tabs or flange portions that can engage opposite side surfaces of the module body; and a plate or intermediate section can be provided therebetween. The intermediate section can connect the tabs or flanges of the inserts, with the slots of the inserts at least partially formed therein and extending therealong. Alternatively, a bearing plate of support can be received along the first and second side surfaces of the passage, between the tabs or flanges of the inserts.

Thus, in some aspects of the present disclosure, a gauge part assembly for a tufting machine, comprising at least one module having a module body with a passage defined therethrough; and a series of gauge parts received within the passage of the module body, each gauge part including a body with a first portion and a second portion having a throat, wherein the gauge parts are carried with their modules in a first direction toward and away from engagement with associated needles of the tufting machine to pick up loops of yarns from the needles along the throats of the gauge parts, and wherein the gauge parts are selectively movable in a second direction along the passage of the module body; wherein the first and second inserts are arranged along opposite sides of the passage of the module body, each insert formed from material having a hardness that can be greater than a hardness of the metal or composite material of the module body and having a series of spaced slots configured to receive at least a portion of one of the gauge parts therealong; wherein the slots of the first and second inserts are substantially aligned across the passage; and a plurality of actuators each actuator coupled to the first portion of an associated gauge part of the series of the gauge parts and adapted to move their associated gauge parts in the second direction through the passage of the at least one module, whereby the gauge parts are extended or retracted through the module body so as to move the throats of the gauge parts between extended positions for engaging and picking loops of yarns from the needles and a retracted position to substantially avoid picking loops of yarns from the needles.

In still other embodiments, the gauge part assembly can include first and second inserts that each comprise a body machined, molded or cast from a metal, carbide or powdered metal material and including a tab or flange portion in which the slots are formed. Still further, the body of each of the first and second inserts further comprises upper and lower tab or flange portions engaging upper and lower surfaces of the module body, with the slots extending through the upper and lower tab or flange portions.

In some aspects of the present disclosure, a method of operating a tufting machine is disclosed, wherein, according to one example embodiment of the present disclosure, as the needles of the tufting machine are reciprocated into and out of the backing, the gauge parts will be reciprocated in a first direction toward engagement with the needles. In addition, the actuators of at least selected ones of the gauge parts can be selectively engaged or disengaged so as to move their corresponding gauge parts between a fully retracted or no-sew position at which gauge parts will not engage an associated or corresponding needle, and thus no loop of yarn will be formed thereby, and varying extended or raised positions, including a fully extended position. In their raised or extended positions, the gauge parts engage the needles at the take-off portions thereof, as the needles pass into and out of the backing material, to pick-up loops of yarns from the needles.

In addition, in embodiments, as the needles are reciprocated out of the backing, the yarn feed therefor also can be controlled so as to cause non-selected yarns, e.g. yarns that are not engaged or picked-up by associated ones of the gauge parts when such associated gauge parts are in a lowered, no-sew position, so as to be generally retained with their needles and be retracted, withdrawn, or otherwise pulled back or out of the backing material with their needles. In other instances, the gauge parts can be moved to elevated or raised positions prior to or while engaging loops of yarns, and the yarn feed can be controlled to retract, back-rob or pull back some loops of yarns to an extent sufficient to prevent such yarn from being shown at that stitch location in the finished patterned article. The loops of yarns picked up from the needles also can have varying pile heights or lengths depending upon the position and/or movement of the gauge parts with respect to their associated or corresponding needles. For example, in a fully raised position, a smaller or decreased length loop of yarn can be formed by control of the yarn feed for such yarn(s) for controlling a pile height thereof, e.g. for creating a lower pile height, or even substantially hidden loops of yarns in the backing, including such loops being substantially removed (e.g. such as by being maintained/retained with their needles and not picked-up by the gauge parts in a lowered, no-sew position) by control of the yarn feed thereof.

In embodiments, longer loops of yarns can be picked up and formed by loopers as the loopers are moved to lowered positions, pulling the loops of yarns therewith, as needed, so as to create higher or greater pile height tufts of yarns in the backing. In addition, the actuators further can be controlled to selectively cause their corresponding gauge parts to be lowered or retracted with a loop of yarn captured thereon, to form still longer loops of yarns to enable additional patterning effects, such as for tip shearing and the like.

The needles further generally can be shifted laterally with respect to the longitudinal movement of the backing through the tufting zone in order to present different color or different type yarns to each stitch location of the pattern being formed in the backing material. For example, the needles of the needle bar or bars can be threaded with a series of desired colors in various thread-up sequences. In addition, the backing material typically can be run at an actual or effective stitch rate that is substantially greater than the prescribed or desired pattern stitch rate for the pattern being formed. As a result, as the needles are shifted, a desired number of different color or type yarns can be presented to each stitch location. By control of the positioning and/or movement of the gauge parts, loops of yarns can be selectively formed in the backing material, and with the formation of such loops of yarns further being controllable for forming varying pile heights of the resultant tufts in some embodiments. For example, in various aspects, a series of different color or type yarns can be presented to each stitch location as the needle bars are shifted, and if a tuft of a particular color or type yarn is not selected to be sewn at that stitch location, the corresponding gauge part can be held in a retracted or lowered position such that the loop of such a non-selected yarn generally will not be formed.

Still further, in embodiments, the feeding of the backing material will be controlled. For example, in embodiments, the backing feed can be controlled in conjunction with the shifting of the needles, the control of the yarn feed and control of the positioning of the gauge parts, such that the backing feed can be fed at a higher operative, effective or actual stitch rate to enable formation of a substantially increased number of presentations of yarns into the backing material to provide substantially full gauge coverage of tufts of selected colors of types of yarns remaining in the face of the tufted article and substantially avoid a missing color or type of yarn or gap being created, shown or otherwise appearing in the pattern fields of the patterned tufted article. The finished patterned tufted article thus can be provided with a density of tufts per inch that substantially matches a desired or prescribed pattern stitch rate, i.e., for patterns designed with a pattern stitch rate of 8, 10 or 12, or other numbers of stitches per inch, the resultant finished patterned tufted article can be formed a density of visible and/or retained face yarns or tufts per inch that can approximately match the pattern stitch rate.

The foregoing and other advantages and aspects of the embodiments of the present disclosure will become apparent and more readily appreciated from the following detailed description and the claims, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced. Those skilled in the art further will appreciate and understand that, according to common practice, the various features of the drawings discussed below are not necessarily drawn to scale, and that the dimensions of various features and elements of the drawings may be expanded or reduced to more clearly illustrate the embodiments of the present disclosure described herein.

DETAILED DESCRIPTION

Figure 1:
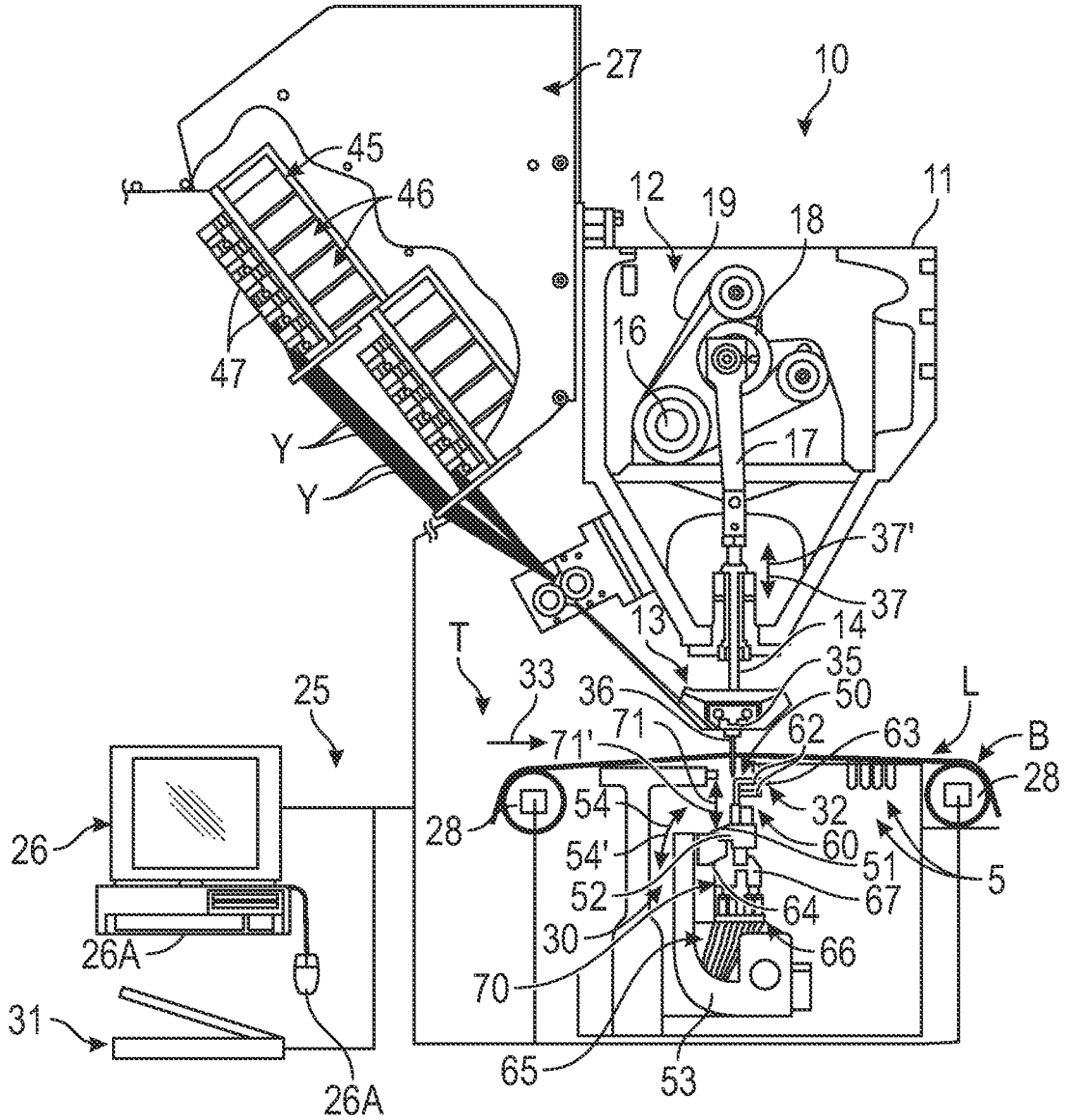
FIG. 1 is a side elevational view of one example embodiment of a tufting machine with selectively controllable looper assembly according to the principles of the present disclosure.

Referring now to the drawings in which like numerals indicate like parts throughout the several views, FIGS. 1-9B generally illustrate an embodiment of a tufting machine 10 and method for forming patterned tufted articles, according to the principles of the present disclosure, wherein placement of stitches or tufts 5 of yarns Y can be at desired locations in a backing material B can be controlled. Such tufts or stitches can be formed with a sculptured, multi-pile height tufted appearance, and further can be placed with enhanced selectivity and/or control, for formation of further varying or free-flowing pattern effects. For example, the tufted article can be formed with the tufts of yarns formed at varying pile heights to provide sculptured looks, and with different color or type yarns for formation of multi-color patterns of various geometric and/or free-flowing designs. Additionally, it will be understood that various numbers of different type and/or color yarns (i.e., two color, three color, five color, six color, etc.), can be used to form multiple pile height patterned tufted articles according to the principles of the present disclosure.

As generally illustrated in FIG. 1, in one embodiment, the tufting machine 10 will include a frame 11, which can include a head or upper portion 12 housing a needle bar drive 13 and defining a tufting zone T. The needle bar drive mechanism 13 (FIGS. 1 and 2) typically includes a series of push rods 14 that can be connected to a needle bar drive 16 (such as a gear box/assembly) shown in FIG. 1 or similar mechanism, by connector rods 17, which needle bar drive 16 in turn can be connected to and driven off a main drive shaft 18 of the tufting machine, for example by one or more drive belts or drive chains 19, and with the main drive shaft 18 itself being driven by a motor such as a servo motor. Alternatively, the push rods 14 of the needle bar drive mechanism 13 can be connected via connector rods 17 to the main drive shaft 18 so as to be driven directly off the main drive shaft, or by an independent drive system (not shown).

An encoder or similar sensor additionally can be provided for monitoring the rotation of the main drive shaft and reporting the position of the main drive shaft to a control system 25 (FIG. 1) controlling the operation of the tufting machine 10. The control system 25 generally can comprise a tufting machine control including a computer/processor or system controller 26 with an operator interface 26A, such as a touch screen, keyboard, mouse, etc., through which the operator can input patterns, make adjustments, etc. In some embodiments, the control system 25 can comprise or include a stitch distribution control system such as disclosed in U.S. Pat. No. 8,359,989, the disclosure of which is incorporated by reference as if set forth fully herein, with the controller 26 further including programming for control methodology for forming tufted patterns, including sculptured patterns having tufts formed at multiple pile heights, as well as with various color/stitch placement controlled patterns such as disclosed in U.S. Pat. No. 8,359,989.

Figure 2:
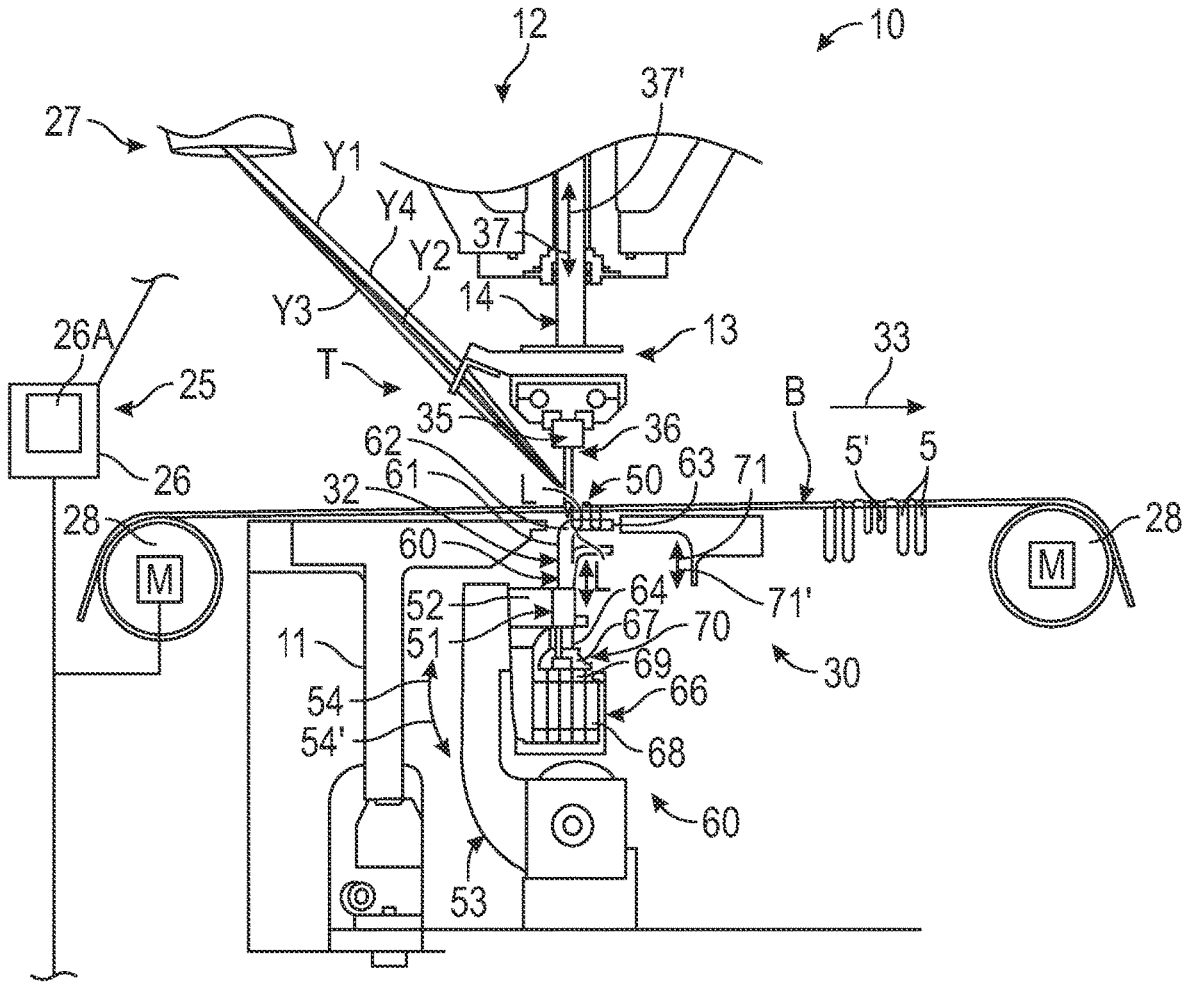
FIG. 2 is a side elevational view of the tufting zone of the tufting machine of FIG. 1.
Figure 3:
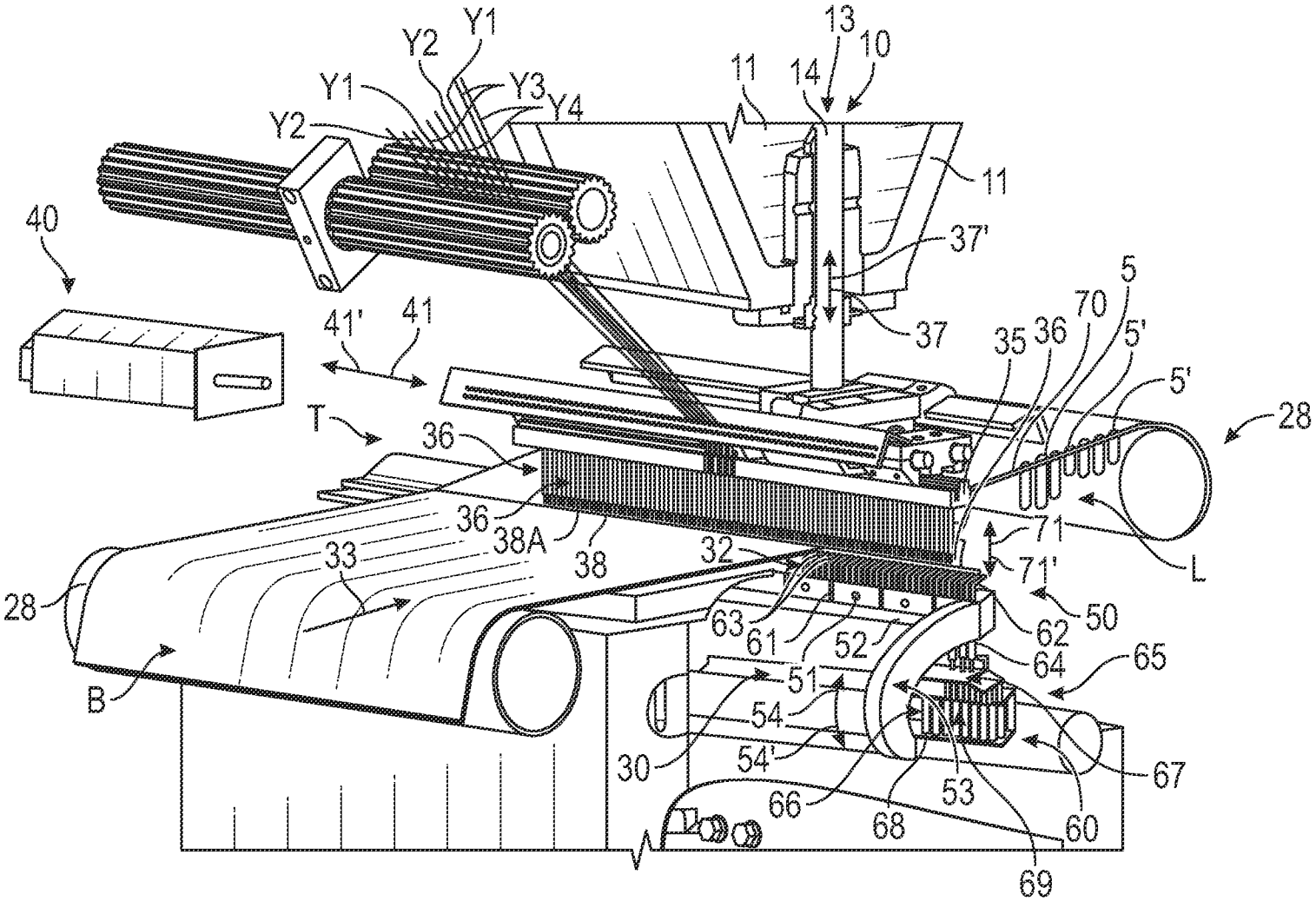
FIG. 3 is a perspective view of the tufting machine of FIGS. 1-2.

The control system 25 generally will include programming enabling the monitoring and control of the operative elements of the tufting machine 10, such as the needle bar drive mechanism 13, yarn feed attachments 27, backing feed rolls 28, the main drive shaft 18, a needle bar shift mechanism 40 (FIG. 3) and a gauge part assembly 30 mounted beneath the tufting zone T of the tufting machine in accordance with the calculated/determined pattern instructions, as discussed more fully below. The control system 25 (FIG. 1) further can receive and execute or store pattern information in memory storage of the system controller 26. In response to developed/programmed pattern instructions, the control system 25 will control the operative elements of the tufting machine 10 in order to form the desired tufted patterns in the backing material B as the backing material is passed through the tufting zone T in the direction of arrow 33 by the backing feed rolls 28, as indicated in FIGS. 1-3.

In some embodiments, the system controller 26 of the control system 25 generally can be programmed with instructions for forming one or more desired patterns for one or more tufted articles, including a series of pattern steps, which steps can be created or calculated manually or through the use of design centers or design software as understood by those skilled in the art or can receive such patterns via input from a disk, USB or other external drive, or through a network connection. Alternatively, the controller 26 can include image recognition software to enable scanned and/or designed pattern images, such as designed patterns, including pile heights and other characteristics such as placement of loop pile and cut pile tufts in the pattern shown by, for example, different colors or similar markers or indicators, as well as photographs, drawings and other images, can be input, programmed, recognized and processed by the control system, including receiving inputs from a design center or through various design software systems, or via a scanner or other imaging device 31 (FIG. 1). The control system can recognize and identify various pattern characteristics, including colors and/or difference in texture of a designed pattern image indicative of texture effects such as placement or location of loop and/or cut pile tufts, and can assign selected yarns thereto.

Additionally, in embodiments such as where the control system 25 can operate in conjunction with or also can comprise or include a stitch distribution control system, as disclosed in U.S. Pat. No. 8,359,989 (incorporated by reference as if set forth fully herein). For example, and without limitation, the control system can incorporate programming to provide for the functionality of such a stitch distribution control system, or a separate stitch distribution control can be linked thereto. The control system also can be provided with software/programming to enable reading and recognition of colors of an input scanned pattern, and can assign supply positions for the yarns being supplied from a supply creel to various ones of the needles based on the thread-up sequence of the needles of the needle bar so as to optimize the supplies of the various color yarns in the creel for the best use thereof, to form recognized pattern fields from pattern images. The control system further can include programming enabling it to create pattern fields or mapping of the pattern, including mapping a series of pattern pixels or tuft/stitch placement locations identifying the spaces or locations at which the various color yarns and/or cut/loop pile tufts will be selectively placed to form the imaged pattern. A desired pattern density, i.e., a desired number of stitches per inch to appear on the face of the finished patterned tufted article, also can be selected and an actual effective or operative process stitch rate for the pattern calculated to achieve the appearance of the desired fabric stitch rate of the pattern.

The control system 25 of the present disclosure further can include programming to receive, determine and/or execute various shift or cam profiles, or can calculate a proposed shift profile based on a scanned, an input, or other designed pattern image or pattern file. For example, in one non-limiting embodiment, a designed pattern file image, photograph, drawing, etc., can be loaded, scanned, or otherwise input at the tufting machine or by a network connection, and the control system can read, recognize and calculate the pattern steps/parameters, including control of yarn feed, control of backing movement and/or needle reciprocation to form tufts in the backing at an effective stitch rate to achieve a desired pattern density, a cam/shift profile, and arrangement of yarns to match the scanned and/or designed pattern image, and can thereafter control the operation of the tufting machine to form this selected pattern. An operator additionally can select or modify stitch rates, yarn feeds, a selected cam profile or a calculated shift profile, such as by indicating whether the pattern is to have 2, 3, 4, 5, 6 or more colors, or a desired number of pattern repeats, and/or can manually calculate, input and/or adjust or change the creel assignments, shift profiles and/or a color mapping created by the control system as needed via a manual override control/programming.

As indicated in FIGS. 1-3, the tufting machine 10 further will include one or more needle bars 35 attached to and driven by the push rods 14. The needle bar(s) 35 move a series of needles 36 in a reciprocating motion (shown by arrows 37/37') into and out of the backing material B, so as to carry or insert the yarns Y into the backing. In some embodiments, the needles can be arranged in a single in-line row along one or two needle bars. In other embodiments, the needles 36 can be mounted in a staggered arrangement along a single needle bar or along a pair of needle bars, with offset rows of needles spaced transversely along the length of each needle bar(s) and being staggered across the tufting zone of the tufting machine. The needle bar(s) 35 further can be shiftable transversely across the width of the backing material, so as to shift or step the needles 36 in a direction that is transverse or generally perpendicular to the longitudinal path of travel through the tufting machine. Accordingly, while one example embodiment including a single needle bar 35, with an inline row of needles 36 arranged therealong may be shown in the figures, the present disclosure is not limited to the use of a single needle bar or a particular configuration of needles. Instead, it will be understood by those skilled in the art that additional arrangements of dual needle bars and single needle bars having spaced rows of needles 36 that can be arranged in-line or in staggered or offset configurations, and both of which further can be shifted, also can be utilized in the tufting machine 10 incorporating the system according to the present disclosure.

Figure 5B:
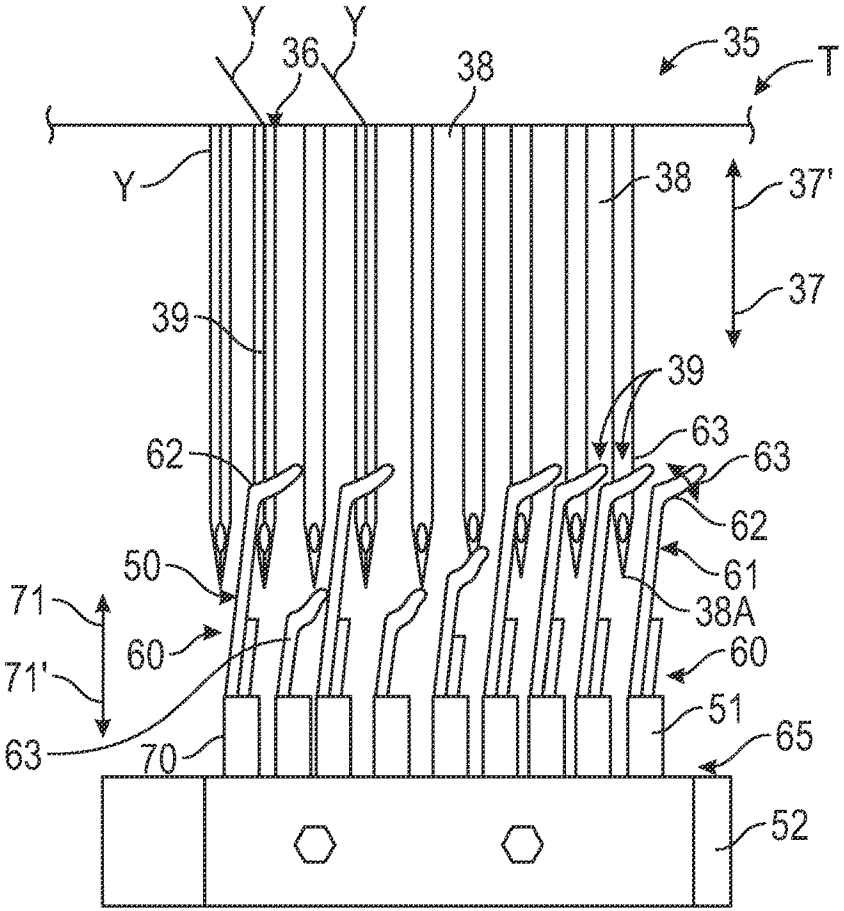
FIGS. 5A-5B are perspective views of a portion of a series of needles and their respective gauge parts in one example embodiment in accordance with the principles of the present disclosure.
Figure 5A:
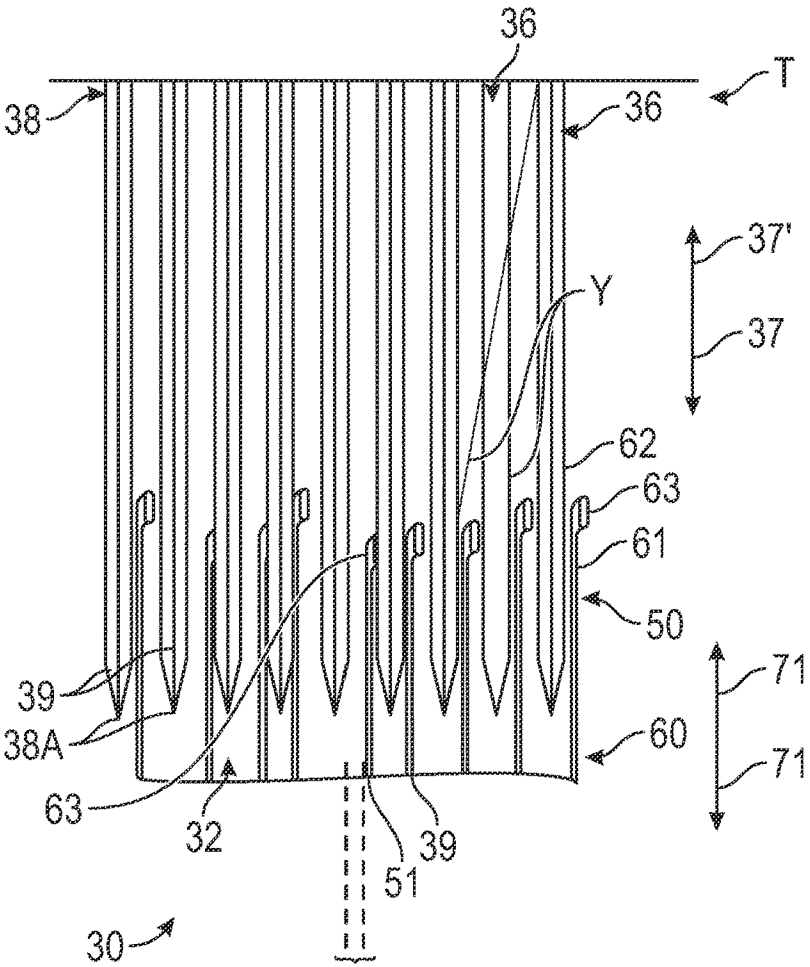
Figure 6A:
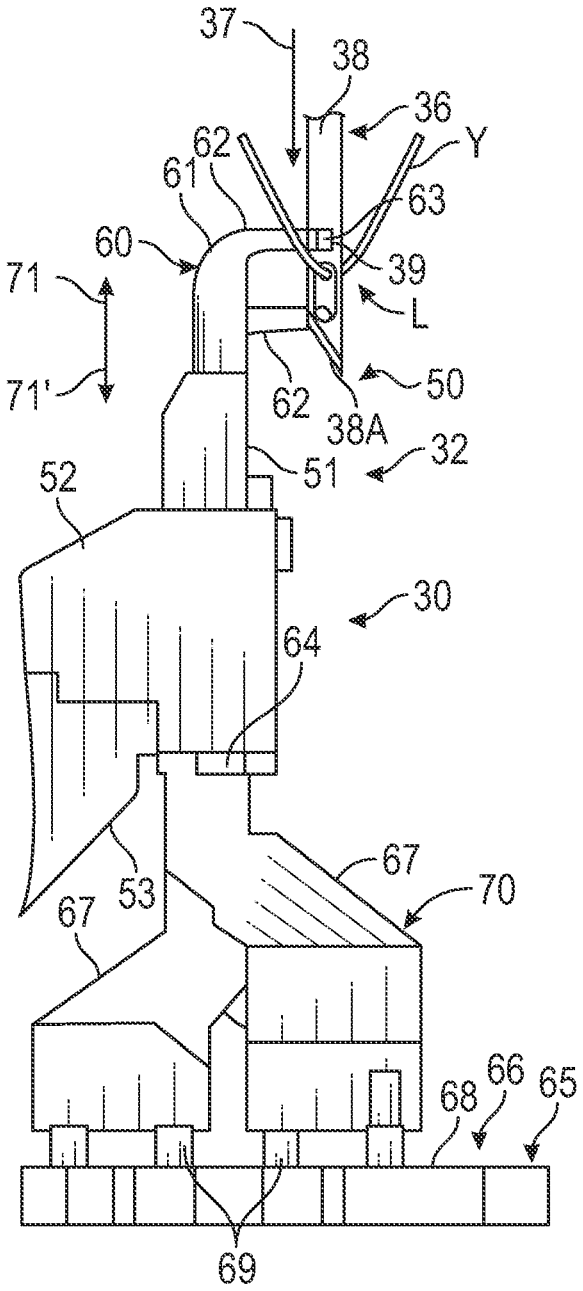
FIGS. 6A-6C are side elevational views illustrating an embodiment of an operation of the selectively actuatable gauge parts in accordance with the principles of the present disclosure.
Figure 6B:
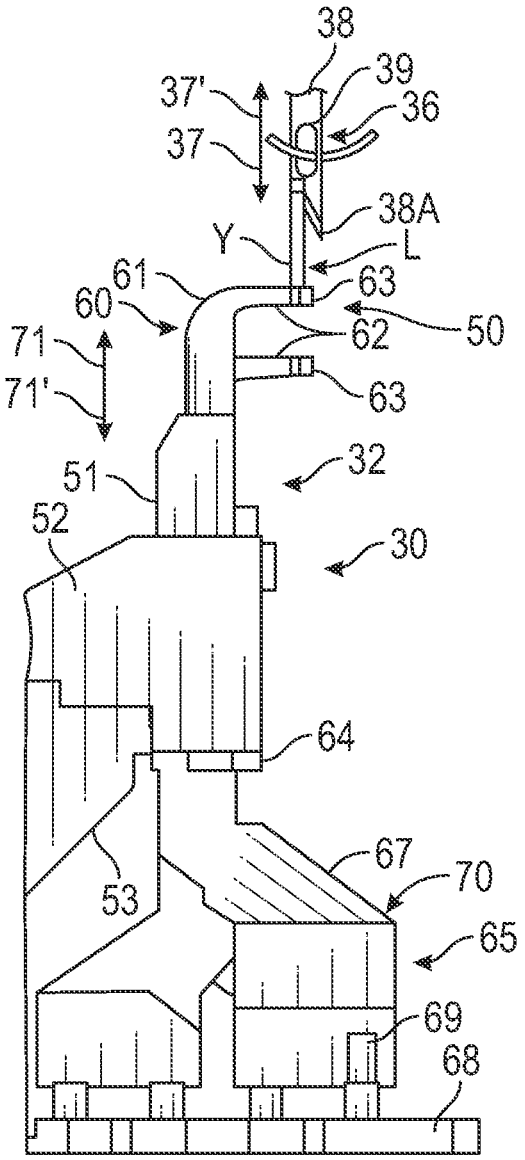
Figure 6C:
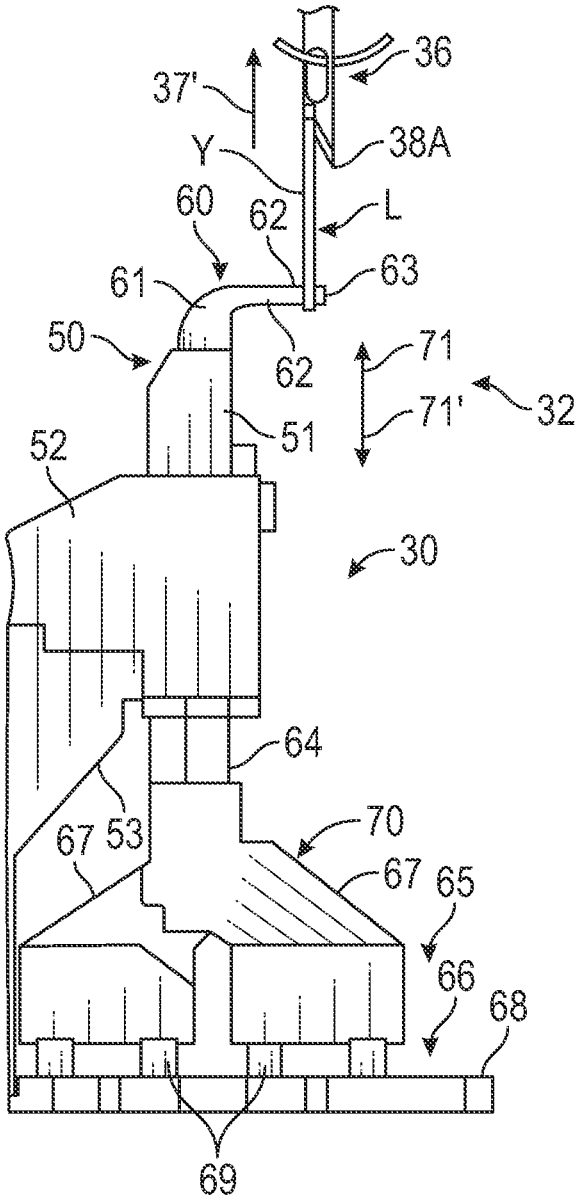

Each of the needles generally will include a shank or body 38 terminating at a pointed end 38A, and including a take-off point or area 39 where the gauge parts 32 can engage and pick-up yarns Y from the needles, such as indicated in FIGS. 5A-6C. As the needles are reciprocated in substantially vertical motion in the direction of arrows 37 and 37' (FIG. 2), they penetrate into and out of the backing material B along a stroke to a desired or predetermined penetration depth, carrying the yarns Y therewith, and will be selectively engaged by gauge parts 32 of the gauge part assembly 30, as shown in FIGS. 6A-6C to pick up loops L of the yarns from the needles. Additionally, as illustrated in FIG. 3, a shift mechanism 40 also can be linked to the needle bar 35 (or needle bars) where used for shifting the needle bar in the direction of arrows 41 and 41', transversely across the tufting zone according to calculated or computed pattern instructions. The shift mechanism 40 can include a Smart Step™ type shifter as manufactured by Card-Monroe Corp., or alternatively can include various other types of shift mechanisms including servo-motor or hydraulically controlled shifters, and/or pattern cam shifters as are conventionally used. Additional shift mechanisms including backing material or jute shifters, operable separately or in conjunction with a needle bar shifter for shifting the backing material laterally with respect to the needles also can be used.

As further illustrated in FIG. 1, one or more yarn feed mechanisms or attachments 27 can be mounted to the frame 11 of the tufting machine 10 for controlling the feeding of the yarns Y to each of the needles 36 during operation of the tufting machine. For example, as indicated in FIG. 3, a series of different type or color yarns (Y1-Y4) can be fed in a selected thread-up sequence or series (e.g., ABCD) to each of the needles, with the thread-up sequences generally being determined or selected based upon a pattern being run. Additionally, while one yarn feed unit 27 is shown along one side of the tufting machine 10 (for purposes of illustration), in other embodiments, multiple yarn feed units can be mounted on one or both sides of the tufting machine, for feeding yarns to the needles 36 of one or more needle bars 35.

There are a variety of yarn feed attachments that can be utilized with the stitch distribution control system of the present disclosure for controlling the feeding of the different yarns Y to various ones of the needles 36. The pattern yarn feed attachments or mechanisms 27 (FIG. 1) can comprise conventional yarn feed/drive mechanisms such as roll or scroll pattern attachments having a series of rolls extending at least partially along the tufting machine and driven by motors under direction of the control system 25 for controlling the feeding of the yarns across the tufting machine to form pattern repeats and/or multiple pile heights and/or other texture effects across the width of the backing material. Such yarn feed mechanisms or attachments can include Quick Thread™, Enhanced Graphics™, and/or Multi Pile Height Scroll yarn feed controls/attachments as manufactured by Card-Monroe Corp.

In some embodiments, pattern yarn feed attachments can be used which have multiple yarn feed drives 45, as indicated in FIG. 1, each including a motor 46 and a feed roll 47, for controlling the feeding of specific sets of repeats of yarns to selected needles, including the use of individual yarn feed rolls or drives 45 for controlling the feeding of single yarns (or ends) or multiple ends of yarns (i.e., 2-4 or more yarns) to the needles 36, such as single and multi-end/servo-scroll attachments, including Infinity™ and Infinity IIE™ systems as manufactured by Card-Monroe Corp. Thus, while in FIG. 1 a yarn feed such as a single or multiple end type yarn feed mechanism 27 is shown, it will be understood by those skilled in the art that the pattern yarn feed mechanisms utilized to control the yarn feed can include single or double end yarn feed controls, scroll, roll, and/or similar attachments, and/or various combinations thereof, and further can be mounted along one or both sides of the tufting machine. Still further, in embodiments, the control system 25 can include programming to perform yarn feed compensation and/or yarn feed modeling to help control and reduce or minimize the amounts of non-retained/non-appearing yarns to be fed to avoid excess feeding of yarns and thus minimize waste during a tufting operation.

The yarn feed attachment can be controlled to selectively feed the yarns to their respective needles in cooperation with the other operative systems of the tufting machine, including the backing feed, shifting of the needle bars and the operation of the gauge part assembly 30, to enable control of the presentation of a number of different colors or types of yarns into the packing and the selective pick-up and retention of loops of selected or desired ones of the presented yarns (e.g., yarns selected to appear in the face of the finished patterned article) to form tufts of such yarns with selected or desired pile heights. In addition, the surface or face yarns or tufts that are to appear on the face of the tufted article can be controlled so as to be fed in amounts sufficient to form such tufts of the selected color or type yarns at desired or prescribed pile heights, while the non-appearing yarns that are to be hidden in particular color and/or texture fields of the pattern may not be picked-up by the gauge parts to avoid such yarns interfering with the face yarns or retained tufts that are to be visible in the pattern field, and to avoid creating an undesired space or gap between the retained tufts or face yarns.

In an embodiment, each color or type yarn that can be placed/tufted at each pixel or stitch location generally either can be presented to such pixel or stitch location for tufting, with only the yarn(s) selected to be shown or appearing at the pixel or stitch location being retained and formed at a desired pile height. Thus, for a 4 color pattern, for example, each of the 4 color yarns A, B, C and D that can be tufted at a particular pixel or location can be presented to such pixel with only the selected yarn or yarns of the pattern, e.g., the "A" yarn, being retained, while the remaining, non-selected yarns, B, B-C, B-D, and/or other combinations, can be presented and not picked-up by gauge parts that are in a lowered, no-sew positon, so as to generally avoid forming loops of such yarns at such pixels or stitch locations, with the yarn feed therefor being controlled to withdraw such yarns with their needles. In some cases, if loops of yarns are picked-up, they further can be pulled back to an extent sufficient to tack or hold the yarns with the backing but without interfering with the placement of the retained yarns as such a pixel or stitch location. Accordingly, when a yarn is presented to a pixel or stitch location, if the yarn is to be retained or appear in the pixel or stitch location, the yarn feed 27 can be controlled to feed an amount of yarn so as to form a tuft of yarn at the pixel or stitch location. If no yarns are selected for insertion at a particular pixel or stitch location, the gauge parts can be controlled to be moved to a no-sew position where by they will not pick-up loops of yarns presented to particular pixels.

As further shown in FIGS. 1-3, the gauge part assembly 30 generally is mounted below the bed 34 and tufting zone T of the tufting machine 10. As the needles penetrate the backing material, they are engaged by a series of gauge parts 32 of the gauge part assembly 30 so as to form loops L (FIGS. 2-3) of the yarns Y for forming tufts 5 of yarns of selected colors or types, and with selected lengths or pile heights. The gauge parts 32 of the gauge part assembly 30, in various embodiments, can include a series of loopers or hooks 50, each of which can be slidably mounted within a gauge module, gauge block or other holder that can be mounted along a gauge bar 52 or similar mount or attachment for coupling the gauge parts to a drive mechanism, such as a pivoting arm 53 that can be driven off of the main draft shaft of the tufting machine, or can be driven by a separate motor/drive for driving a reciprocating movement of the gauge parts in a first direction toward and away from the needles 36, as indicated by arrows 54 and 54' in FIGS. 1-3. It further will be understood by those skilled in the art that various types of gauge parts, including cut pile hooks, loop pile loopers, level out loop loopers, cut/loop clips or other gauge parts also can be used.

Figure 4:
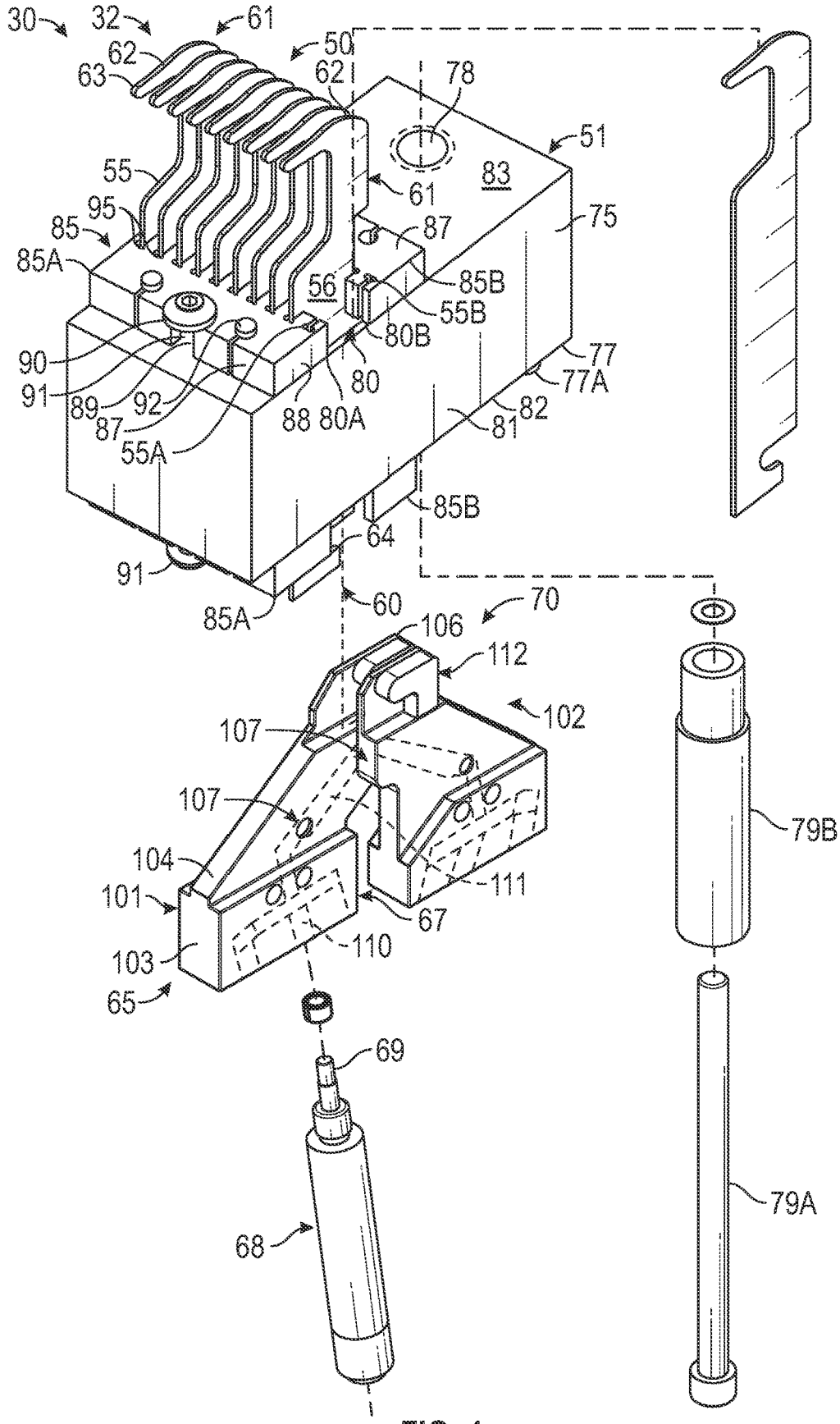
FIG. 4 is an exploded perspective views of an example embodiment of a gauge module or gauge block and gauge parts moveable therethrough, and a gate or connector of a connector assembly connecting the gauge part to an actuator according to principles of the present disclosure

As indicated in FIG. 4, in one embodiment, the gauge parts 32 can include loopers or hooks 50, each having an elongated body 55 that can be slidably mounted within and can be moveable through its gauge module 51. The body 55 of each looper or hook 50 will include a first portion 60, a second portion 61 including an elongated throat 62 that, in one embodiment as shown in FIG. 4, generally can extend at an angle with respect to an intermediate portion 56 of the body 55, and which can terminate at a generally pointed proximal end or bill 63. For example, the throat 62 and proximal end 63 can be configured similar to a loop pile looper. Other configurations of gauge parts also can be used. As further indicated in FIG. 4, the first portion 60 of the body of each looper or hook 50 generally will project through the gauge module or block 51, and can have a slot or recess 64 formed therein, by which the looper or hook can be engaged and/or coupled to a drive system 65 for controlling the selective movement of one or more of the gauge parts individually or is sets or groups. In embodiments, the drive system 65/150 can will include actuators 66 (FIG. 2), each of which will be connected or coupled to a corresponding or associated one of the gauge parts as by a gate or connector 67 (FIG. 4) of a connector assembly 70.

FIG. 4 illustrates one example embodiment of a gauge module or gauge block 51, which includes a body 75, that can have a substantially rectangular or square configuration as shown, although other configurations also can be used, and in which a series or set of gauge parts 32, such as loopers or hooks 50 are received. In some embodiments, the module body 75 of each gauge module 51 will be formed from a metal or metal alloy material, although various composites, synthetic materials and/or other materials also can be used. For example, and without limitation, the body of the gauge module can be made from a lightweight steel, such as a mild steel or tool steel, or aluminum, or other, similar lightweight yet substantially rigid and durable materials. In embodiments, the module bodies can be machined, molded, or cast or otherwise formed. The material from which the body of the gauge module is formed further can be selected to provide a reduction of weight to the gauge modules, while still providing sufficient durability and rigidity to hold and/or substantially maintain the gauge parts in their alignment or position for engaging the take-off portions of the needles during reciprocation of the gauge parts into and away from engagement during operation of the tufting machine.

As generally illustrated in FIG. 4, the module body 75 of each gauge module 51 will include a first, forward or front section 76, and a second, rear or back section 77. The rear section 77 of the body 75 of each gauge module 51 further generally will be configured to engage and mount to a gauge bar, such as illustrated in FIG. 3. For example, the rear section of the body can include tabs or other locating devices 77A for aligning the gauge module along the gauge bar and further will include at least one fastener opening 78. A removable fastener such as a socket, hex screw, or other, similar removable fastener or attachment device, will be inserted through the fastener opening 78 and into a corresponding opening in the gauge bar for releasably mounting the gauge module 51 to the gauge bar. As a result, in some embodiments, the gauge modules, with their gauge parts contained therein, can be removed and replaced as a unit, without necessarily having to replace individual gauge parts; for example, to expedite a change out of broken or damaged gauge parts, or for changing the gauge spacing or arrangement of the gauge parts of the tufting machine.

For example, and not limitation, as indicated in FIG. 4, a fastener 79A, such as a bolt, or other, similar removable fastener, can be received within a sleeve or guide member 79B that can extend through the needle bar or a block or other part mounted to the needle bar, and further can include an upper portion that projects through the body 75 of the gauge module 51. The fastener can include threaded body that engages the body of the module to secure the module body to the needle bar, while allowing for removal and replacement of the gauge modules as needed.

As further indicated in FIG. 4, a passage 80 generally will be formed through the body 75 of each gauge module 51, with the passage 80 generally located along an intermediate portion 81 of the body between the first and second sections 76/77 thereof. The passage 80 will be sized and/or configured to receive a plurality of gauge parts, such as loopers or hooks 50, therein. In embodiments, the body 55 of each of the loopers or hooks 50 generally will be received within and extend through the passage 80, with the first portions 60 of each of the loopers or hooks generally projecting downwardly past the lower or bottom surface 82 of the module body 75, while the second portion 61 of each looper or hook can extend/project upwardly from and above the upper or top surface 83 of the module body 75.

In addition, one or more inserts 85 can be mounted to the opposite side surfaces, e.g. the upper and lower surfaces, of each module body, in positions or locations aligned along the passage 80 defined through the whole body of each gauge module, as generally indicated in FIG. 4. The inserts will be configured to engage and guide the gauge parts as the gauge parts are moved through and along the passage of the gauge module body. For example, in embodiments, such as illustrated in FIG. 4, pairs or sets of inserts 85A and 85B can be provided, with one of the inserts (e.g. a first insert 85A) being mounted along a first, left or forward side 80A of the passage 80, while the insert (e.g., a second insert 85B) is mounted along a second, right or rearward side 80B of the passage 80, and with each of the inserts 85A and 85B generally being arranged in a substantially facing, opposed, parallel relationship with the gauge parts 32 engaged and moveable therebetween. Also, in some embodiments, a pair of first inserts can be mounted along the top and bottom surfaces of the module body along the 1st or left side of the passage, and a pair of second inserts 85B can be mounted along the top and bottom surfaces of the module body along the 2nd or right side of the passage.

Each of the inserts 85 generally will be formed from a hardened metal or metal alloy material, a metal carbide, ceramics, and/or powdered metal materials including metal powders including tungsten, titanium, or other materials that can have a hardness that is greater than a hardness of the material of the gauge module body. For example, in some embodiments, the inserts can be formed from a metal carbide material having a hardness of approximately 74+ RC or greater, while the module body can be formed from a mild steel. In other embodiments, the inserts can be formed from ceramics, powdered metal materials including tungsten, titanium or similar hard metal components, metal carbides, or other materials with a hardness of between approximately 74+ RC to approximately 85+ RC, or greater.

Each of the inserts 85 further each can include an insert body 86 having a tab or flange portion 87 that extends either forwardly or rearwardly, from the passage of the gauge module body, generally seating upon and engaging the upper and lower surfaces 83/82 of the module body. Each of the inserts 85 also will include at least one opening or slot 89 formed along the tab or flange portion thereof, and through which a fastener, such as a set screw 90, or other, similar removable fastener, can be received. The slots or openings 89 formed in the tabs or flange portions inserts generally can be aligned with a corresponding slot or locator opening 91 formed along the upper and/or lower surfaces 83/82 of the module body to help locate and mount each insert to the body of its module and along the passage of its gauge module. The inserts can be shifted laterally, across the module body and substantially parallel to the passage 80, and further can be adjustable toward and away from each other across the passage of the gauge module body, after which fasteners can be inserted therein and tightened to secure the inserts 85 to their module body. Additional locator guide pins 92 further can be received in slots or locator openings formed along flange or tab portions 87 of each of the inserts to additionally help position the inserts along and across the passage of the module body as needed.

In additional embodiments, the inserts 85 can be substantially integrated with their modules. The inserts can be bonded, molded, encapsulated, and/or otherwise affixed to the bodies of their modules, with the inserts being substantially integrated with the module bodies so as to form a substantially unitary construction of the module bodies, and with the inserts forming or defining a portion of the passages thereof. For example, in some cases, the inserts can be located or received within the passages of the module bodies and substantially permanently mounted thereto, while in other embodiments, the inserts can be machined, molded or cast as a part of the module bodies themselves, defining the passage and slots for the loopers or hooks, and can be coated or treated with a hard metal coating such as a carbide or other substantially wear resistant coating. In such instances, the gauge parts can be provided in sets with their gauge modules, and can be replaced as a set by removal and replacement or substitution of the gauge modules and gauge parts as a unit. In other embodiments, the inserts can be substantially engaged or locked to their modules with a limited ability to detach or remove one or more of the inserts as needed for serviceability.

As additionally indicated in FIG. 4, the inserts further generally will include a series of slots or slits 95 arranged in spaced series along the body 86 of each insert, along a rear portion 88 thereof. Each of the slots 95 generally will be sized or configured to receive a gauge part 32, such as a hook or looper 50, as indicated in FIG. 4. The slots 95 of the inserts also generally will be arranged at a selected spacing, such as a gauge spacing for the gauge parts, and with each slot 95 of the first inserts 85A being generally aligned with a corresponding or associated one of the slots 95 of the second inserts 85B. The aligned, corresponding or associated slots of each insert will receive at least a portion of the body of each of the gauge parts received therein, e.g., portions of the front 55A and rear 55B edges of the body 55 of each looper or hook 50; and with the inserts defining contact areas 98 of a reduced or minimized area or profile between the gauge module and the loopers or hooks.

In some embodiments, the ends 96 of the slots 95 further can be formed with a substantially so as to define a seat or bearing surface against which the first and second edges of each of the loopers or hooks received in each slot can be located, and can bear against, for mounting of the loopers or hooks within the inserts and thereafter securing the inserts, with the loopers or hooks received therein to each gauge module. The slots of the inserts will guide the loopers or hooks as the loopers or hooks are extended or retracted or otherwise moved through the passage of their gauge module, and will help maintain the alignment of the loopers or hooks, and thus the throats and bills thereof with respect to the needles such as needles are reciprocated into and out of the backing material and are engaged by the loopers or hooks.

In embodiments, the inserts each can include an insert body 86 having a first, top or upper portion and a second, lower or bottom portion, and with an intermediate section extending therebetween and connecting the first and second portions of the body of each insert. At least one of the upper and/or lower portions of the body of each insert further can be formed as a tab or flange that extends either forwardly or rearwardly, from the intermediate section and the passage of the gauge module body, generally overlying and engaging the upper and lower surfaces 83/82 of the module body to help locate and fix each insert within the passage of its gauge module. The first and second inserts 85A/85B thus can have a substantially unitary construction, including upper and lower portions with their slots extending through their upper and lower sections and along the intermediate body sections, enabling further engagement and guiding of at least a portion of the first and second edges of the loopers or hooks. In embodiments, the inserts can be machined, molded or cast so as to have a substantially unitary body, which can enable a reduction of parts, reducing the need for separate inserts on the upper and lower surfaces of the module body and along opposite sides of the passage thereof, while increasing the points/area of contact between the inserts and the loopers or hooks for enhanced consistency and/or control of the movement.

Alternatively, first, second and intermediate body sections of each insert can be formed as separate components and mounted together along the passage of the module body. For example, in some embodiments, an intermediate guide or bearing plate also can be used to help guide movement of the loopers or hooks, with the guide or bearing plate extending along the passage between inserts located along the upper and lower surfaces of the module body. Such a guide or bearing plate can provide a body or surface along which the first and second or front and rear edges of the loopers or hooks can ride/slide as they are moved along the passage of the module body. The guide or bearing plate also can act as a connecting member or section between the inserts or each pair or set of inserts. Such a guide or bearing plate can be formed from a similar high hardness material (e.g. a metal or carbide, powdered metal or other high hardness material, or a material that has been hardened or coated or bonded with a material having an increased wear resistance or which can comprise a reduced material) to provide a hardened surface against which one or both of the edges of the loopers or hooks can slide; or, in some cases, can act as a sacrificial plate that can be easily replaceable and protects the module body along the sides of the passage.

During operation of a tufting machine such as disclosed in embodiments of the present disclosure, the loopers, hooks, or other gauge parts are moved in multiple directions, including being reciprocated or moved in a first direction into and out of engagement with the needles, while also being moved in a second direction through their gauge modules or gauge blocks, e.g. being moved between raised or extended positions to engage the needles and lowered, positions, including being moved to no-sew positions. In some operations, the gauge parts also can be moved after a loop of yarn has been picked from a needle, such as to form extended or longer length loops. This tufting machine thus enables the formation of highly detailed tufted patterns that can include varying pile heights and other sculptured and multi-color pattern effects. However, such repeated cyclical movements of the gauge parts can cause significant rapid wearing of the gauge parts and particularly their gauge modules as the loopers, hooks or other gauge parts slide and their edges frictionally engage the bodies of their modules. As these parts wear, their ability to engage their needles and form loops of yarns to create tufted patterns with a substantially high degree of precision can be diminished. For example, the gauge parts can become misaligned, and/or may not engage the needles properly or with the desired level of precision, requiring more frequent replacement of the gauge parts/gauge modules.

The use of metals (such as high hardness heat treated steels), metal carbides, ceramics, and/or other high hardness metal materials, including powdered metals including tungsten, titanium or other, similar high hardness materials, which provides the inserts with a hardness of at least 75+ RC or greater, and the configuration of the inserts defining contact areas 98 between the loopers or hooks and the gauge modules with a minimized area or profile, substantially increases the wear life to the gauge modules and the loopers or hooks. The high hardness of the inserts protects the gauge modules from direct contact with and rapid wearing as the loopers or hooks are cycled therethrough, while the reduced size of the contact areas 98 defined by the inserts are configured to reduce frictional engagement of the inserts with the loopers or hooks, while substantially consistently guiding and maintaining the alignment of the loopers or hooks during such movement. The loopers or hooks also generally can be pre-hardened or heat treated so as to harden the looper or hook bodies; and in some embodiments, the surfaces of the looper or hook bodies can be coated, treated or bonded with a reduced friction material to help reduce friction between their edges 55A/55B that engage and slide along the slots of the inserts, and thus help increase wear life thereof. Other coatings that can be applied can comprise materials with increased wear resistance to help protect the loopers or hooks against wearing during use. For example, in some applications, the wear life of the loopers or hooks has been found to exceed upwards of 50 million to 100 million machine cycles, and in some embodiments, between at least about 100 million to 500 million cycles or greater.

The increased hardness of the inserts protects the gauge modules and enables the gauge modules to be formed from substantially lighter weight and lower hardness materials such as mild steels, aluminum, or alloys thereof. For example, instead of requiring the gauge modules to be formed from substantially high hardness materials such as tungsten, and/or be substantially heat treated to try to significantly increase the hardness thereof, the gauge modules can be machined, molded, or cast, or otherwise formed from lightweight metals, composites or other, similar materials with hardness's that can be substantially lower than that of the inserts (e.g. the bodies of the gauge modules can be formed from mild steels or aluminum alloys with a hardness less than about 60 RC) which helps reduce weight and cost of the overall gauge part assembly without reducing operational cycle performance. Such a reduction in weight of the gauge modules or blocks further can provide enhanced control of the movement of the loopers through the passage of their gauge modules, as well as the reciprocation of the loopers or hooks toward and away from the needles, e.g. by reducing inertia that may need to be overcome during the reciprocation of the loopers or hooks toward and away from the needles.

In one embodiment, as generally illustrated in FIGS. 2 and 6A-6C, the actuators can comprise hydraulic, electric, or pneumatic cylinders 68, and in some embodiments, also could comprise motors such as servo motors, stepper motors, linear actuators, voice coil or moving coil actuators, solenoids, or can include other types of actuators, and/or combinations thereof. Each of the actuators can include a cylinder rod or drive shaft 69 that generally will be connected to an associated or corresponding one of the loopers or hooks by connector or gate 67. In some embodiments, the actuators further could be used to control operation of more than one looper or hook 50. In addition, other types of actuators, including solenoids, motors or other, similar actuating mechanisms, as will be understood by those skilled in the art, also can be used.

Each of the actuators generally will be linked to the control system 25, which will selectively control the actuation thereof so as to control the firing and/or movement of each of the loopers with respect to the needles. The actuators will be controlled to selectively extend and retract their loopers or hooks so that the position of their throats/bills can be varied in a second direction with respect to the reciprocation of the needles into and out of the backing material, and with respect to the movement of the loop loopers or hooks 50 in the direction of arrows 54/54'. For example, in embodiments, the loopers or hooks will be moved in a substantially vertical (i.e., a generally up and down) movement with respect to the needles, as illustrated by arrows 71 and 71' in FIGS. 2, 5A-5B, and 6A-6C, as the loopers or hooks are reciprocated in the direction of arrows 54 and 54' toward and away from the needles 36. The actuators can be controlled to not only extend and retract the loopers or hooks between extended and/or no-sew positions, but further can be selectively controlled so as to extend and/or retract the loopers to a series of varying positions or elevations with respect to the stroke or depth of penetration of the needles. Thus, the position or location of the throats of the loopers or hooks with respect to the needles can be controlled and varied so as to cause the pick-up and/or formation of loops of yarns from selected ones of the needles at varying pile heights or lengths, or no pick-up of yarns, such as indicated in FIGS. 6A-6C.

For example, in a fully extended position, selected ones of the loopers or hooks 50 can pick up loops of yarns from the needles engaged thereby, which loops generally can be formed with a first selected or desired pile height, whereas other ones of the loopers or hooks can be extended or retracted to positions or locations between fully extended and retracted positions so as to pick up and form loops of yarns with second or other, differing lengths or pile heights. Some of the loopers or hooks also can be moved to a fully lowered or retracted position by their actuators so as to place them in a no-sew position whereby the throats/bills of such loopers or hooks are located below a full penetration depth or end of stroke of the needles and thus will not pick up loops of yarns from their corresponding or respective needles. In other operations, the actuators can be selectively controlled or triggered to retract or lower their respective loopers or hooks after a loop of yarn has been captured thereon, so as to pull such captured loops of yarns lower, to elongate or create higher pile or increased length yarns for additional patterning effects, such as for tip shearing and/or other texturing effects.

As indicated in FIGS. 5A-5B, each of the gauge parts 32, such as loopers or hooks 50 can be arranged in sets or groups each contained in a module 51 with the modules mounted in series along the gauge bar to provide a plurality of gauge parts arranged at a prescribed spacing (e.g., a gauge spacing such as 1/10th, 1/8th, 5/16th, etc.) across the tufting zone. The gauge parts 32 will be positioned so as to engage the needles, including being arranged in a substantially in-line, offset, staggered, and/or other configuration as needed depending upon the configurations of the needles of the needle bar or needle bars (for example, if the needles are arranged in an in-line, staggered and/or other arrangements along a single or dual needle bars). Each of the loopers or hooks 50 further can be arranged at an angle or offset with respect to the needles penetrating the backing so as to move or be extensible/retractable along an angled path of travel 71/71' with respect to the needles and/or the take-off point thereof. Such an offset movement of the loopers or hooks additionally can be varied as needed to minimize potential engagement of the loopers or hooks by the needles as the loopers are being retracted, depending upon spacing and/or arrangement of needles.

For example, in some embodiments, the loopers or hooks can be arranged and/or moved along a path of travel at an angle/offset, indicated at θ in FIG. 5B, that can range from approximately 1° to approximately 10° or more from the vertical and/or with respect to the stroke of the needles when the loopers or hooks are retracted, and one example embodiment at an angle of approximately 4° to 6° with respect to the path or direction of reciprocation of the needles, as the needles complete their stroke or reciprocation into and out of the backing; while in other embodiments, substantially no offset, i.e., an approximately 0° angle with respect to the needles, can be provided between the loopers or hooks and needles. Thus, as the loopers or hooks are extended to positions/elevations sufficient to engage the take-off areas 39 (FIGS. 5A-6A) of the needles, the throats/bills thereof generally will be properly aligned or positioned to engage and pick-up loops of yarns from their corresponding needles. As the loopers or hooks are retracted, they generally can further be moved along an offset path of travel so that their throats/bills can be placed or located at positions out of the path of travel of the needles to minimize potential inadvertent yarn pick-up when the loopers or hooks are being moved to and/or are in retracted, no-sew positions.

FIG. 4 further illustrates a non-limiting embodiment of a gate or connector 67 that can be used with the gauge parts, such as the loopers or hooks 50 (FIG. 4) for linking the gauge parts to their associated actuators 68/151 (FIGS. 2-4 and 7A-11B). It will, however, be understood by those skilled in the art, that the connectors or gates illustrated in any of the embodiments discussed herein are not limited to use with a particular tufting type of machine or with particular types of gauge parts, and can be used with a variety of different types of gauge parts, including the loopers or hooks 50 such as illustrated in FIGS. 2-6C, and FIGS. 7A-11B, as well as for use with various other types of gauge parts, such as arrangements of level cut loop loopers or hooks and/or other gauge parts.

As generally illustrated in FIG. 4, the connectors or gates 67 generally will each include a housing or support structure 101 within which a connector arm 102 can be substantially contained, encased or housed. The housing 101 of each connectors or gate generally can include a first, or proximal portion 103, an intermediate portion 104, and a second or distal portion 106. In addition, each connector body further will include a passage or channel 107 defined therethrough, and along which the connector arm 102 will be received and can move. The housing 101 of each connector 67 generally can be formed from a lightweight, durable material, such as a composite, plastic, or synthetic material, or combinations thereof. For example, a composite or polymer material such as a nylon, polyamide nylon, or other, similar polymer material, can be used, and can be mixed or provided with or otherwise include a fibrous fill material, such as carbon fiber, a glass fiber, or other supporting fibers that can additionally provide reinforcement to the housing body material. The material of the housings further can be adapted or selected to provide not only a reduced weight, such as to help reduce inertia during starting/stopping and movement, e.g. extension and/or retraction of the gauge parts by their associated actuators, but also to provide elasticity and shock reduction or dampening or cushioning effect during such movements and starting/stopping operations.

In some embodiments, the housing 101 of each of the connectors can be over-molded over its connector arm 102, or can be formed in sections and applied about the connector arm such that its connector arm is substantially enclosed or contained therein. The connector arm 102 further can be made from a metal such as steel or other, similar high strength material, selected to provide high strength and rigidity sufficient to enable each connector arm to withstand repeated shocks and increased movement cycles during operation of the tufting machine. For example, and without limitation, the connector arms 102 can comprise a hardened steel material, and in some cases, can further be heat treated or annealed, such as at the ends thereof, at areas of contact and/or engagement with the loopers or hooks, and between each connector arm and the drive shaft or rod 69 of its associated actuator or actuators 68 such as indicated in FIG. 4. In embodiments, a bushing or sleeve also can be provided at the areas of contact or engagement and connection between the drive shaft or rod of each actuator and its associated gate or connector arm.

In some embodiments, the connector arm 102 further can include a skeletonized metal body configured to enable a reduction of the weight thereof. In such embodiments, the housing 101 of each connector or gate can provide further support and rigidity to the connector arm 102, helping to guide and maintain a consistent reciprocating movement or motion thereof during operations. As a result, the connectors or gates 67 can provide a more economical connector or gate design, enabling linkages or connector arms having a skeletonized or reduced profile and lighter weight to be used with additional support and impact elasticity and dampening effects provided by the housing 101 of each connector or gate applied over and/or encasing or encapsulating the linkages or connector arms.

In various embodiments, each of the connectors or gates 67 can be formed with varying sizes and configurations. For example, the intermediate sections of each connector housing can have shorter or longer spans depending on a gauge, distance, length of travel or the length of the connector arm, and thus can be varied for different tufting machines and/or tufting applications. By way of example only, in embodiments, the connectors or gates can comprise varying configurations for use with different gauge tufting machines, such as ⅛th gauge or 1/10th gauge machines, though it will be understood that other gauges (5/16th, 1/16th, 1/12th, 1/14, etc.) and/or type machines also can be used. The intermediate section of the housing of each connector further can be oriented at an angle, in some cases being oriented at a downwardly extending angle, while in other cases, can be oriented at an upwardly extending angle, with adjacent connectors at opposite angle orientations or configurations to minimize space or the footprint taken up thereby.

The connector arm 102 of each connector or gate 67 further can be formed in varying lengths as needed or desired. Each linkage generally will have a first or proximal end 110, which can be adapted or configured to engage or connect to one or more actuator shafts or drives rod of an associated actuator or actuators, with a generally angled body section or portion 111 that extends along the passage or channel 107 of the housing, through the housing of the connector, and terminating at a distal, flanged or hooked end 112. The body portion 111 of each linkage further will be located and/or aligned within the passage of its housing and enclosed therewithin to help provide stability and/or to help guide movement of the linkage along the channel of its connector housing.

For example, in some instances, pins or other inserts can be used during formation of the housings about or over their linkages to align and support the linkages in position, which pins can be removed thereafter. Alternatively, some guide pins can be provided to help maintain and guide movement along one or more portions of the connector arm, including or acting as bearings. Still further, in some other embodiments, a slot also can be provided along the body of each housing, through which a guide pin can be received to help guide movement of the linkage and can further help provide further impact elasticity.

In additional embodiments, a guide pin or fastener can be inserted through the housing and along a slot or guideway, or similar means for helping guide and control or maintain the movement of the linkage along the passage or channel of its connector housing without twisting or turning or otherwise becoming misaligned. In still other embodiments, a pivot pin can be provided about which the connector arm can be moved or pivoted rather than being moved in a substantially linear movement.

As further indicated in FIG. 4, the distal hooked end 112 of each of connector arm 102 can be supported along at least one side thereof by the second or distal portion 106 of its connector housing 101, which can help guide and support the hooked end during the sliding movement of the linkage. The hooked end of the connector arm will engage the corresponding hooked portion, recess or slot of a corresponding gauge part; for example, in embodiments, engaging the slot or recess 64 formed in the first portion 60 or distal end of a corresponding or associated one of the loopers or hooks 50. In other embodiments, the hooked end of the linkage can engage a clip for a level cut looper, a level cut looped looper, or other movable gauge part. As each actuator is selectively fired or activated/deactivated, the movement of its actuator shaft or drive rod will be translated to an associated one of the gauge parts via the connector arm of its corresponding connector or gate The connectors or gates thus can provide an economical, rigid and high strength connection between each of the actuators and their associated gauge parts, with the gauge parts being removable or changeable, as needed, without having to replace the actuators associated therewith.

FIGS. 7A-11B illustrate further, non-limiting embodiments of drive systems 150 for controlling the movement of the gauge parts 32, such as loopers or hooks 50, or other types of gauge parts, in a second direction with respect to the path or stroke of the needles as they are reciprocated into and out of the backing material. In the example embodiments of FIGS. 1-6C, actuators such as electric, pneumatic, or hydraulic cylinders are generally illustrated, though it will be understood by those skilled in the art that other types of actuators also can be used. For example, the drive systems 150 illustrated in FIGS. 7A-11B, actuators 151 are shown as including motors 152, such as stepper motors, torque motors, or other types of motors, although other types of actuators, such as moving coil or voice coil actuators, electric cylinders, linear actuators, solenoids, and/or combinations thereof, also can be used.

In addition, the control system 25 (FIGS. 7A and 9A) of the tufting machine, as discussed above, further will include programming for control of the actuators 151 for controlling movement of the gauge parts 32 (such as loopers or hooks 50), in their second direction, for example, moving the gauge parts in a generally vertical direction as indicated by arrows 71 and 71', to control movement of the gauge parts between extended and retracted positions, including retracting the gauge parts to a fully lowered, no-sew position; as well as for controlling a variable position or elevation of the throats/bills of the gauge parts. The use of actuators such as motors, electric cylinders, linear actuators and the like that are not driven by compressed gases or fluids can substantially minimize or avoid the need for compressors generally needed for driving other types of driven actuators, and can also enable programing and control of movement of the gauge parts between different positions or elevations with increased precision. The gauge parts thus can be moved at smaller increments between a number of positions or elevations with respect to the needles by control of such actuators. For example, and not limitation, the gauge parts could be moved in a direction with respect to the needles in increments that could range from about 1/32-1/16 inch to about ¼-¾ inch to locate the gauge parts at varying positions to create tufts of yarns of varying pile heights, e.g. the gauge parts could be moved vertically or in a direction in addition to a direction of reciprocation of the gauge parts toward and away from the needles to lowered or differential positions of about 1/16 inch, about ⅛ inch, about ¼ inch, ½ inch, ⅝ inch, and/or to a fully lowered position where no loop of yarn is picked-up.

The control system 25 further will include programming enabling the one or more yarn feed attachments 27 to be controlled in conjunction or correlation with the position of the loopers or hooks. For example, in embodiments, such as where single or double/multiple end yarn feed mechanisms (e.g. an Infinity™ yarn feed as produced by Card-Monroe Corp.) are used, the motors 46 of each of the yarn feed drives 45 thereof can be controlled in cooperation with the control of the actuators 151 controlling the positioning of the loopers or hooks so as to minimize or prevent yarn tension in the yarns captured by such loopers or hooks from substantially varying across the width of the pattern. In some embodiments, the control system can control the motors to control movement of the loopers or hooks in their second direction with respect to the needles 36, which movement can be based on multiple or percentage of an amount of yarn being feed by the yarn feed mechanism; e.g. if a selected yarn feed motor is controlled by the control system to feed approximately ½ inch yarn to a selected needle, the actuator corresponding to a looper or hook engaging such a selected needle can be moved approximately ¼ on an inch. In other embodiments or examples, if the yarn feed motor feeds ¼ inch yarn, the corresponding loopers or hooks can be moved approximately $1/8^{th}$ inch. Other multiples or variations of the movement of the loopers or hooks in conjunction with or in relation to the feeding of the yarns to selected needles also can be used as needed to substantially maintain yarn tension and substantially minimize or prevent variation thereof across the pattern width of the tufted pattern being formed.

Figure 7A:
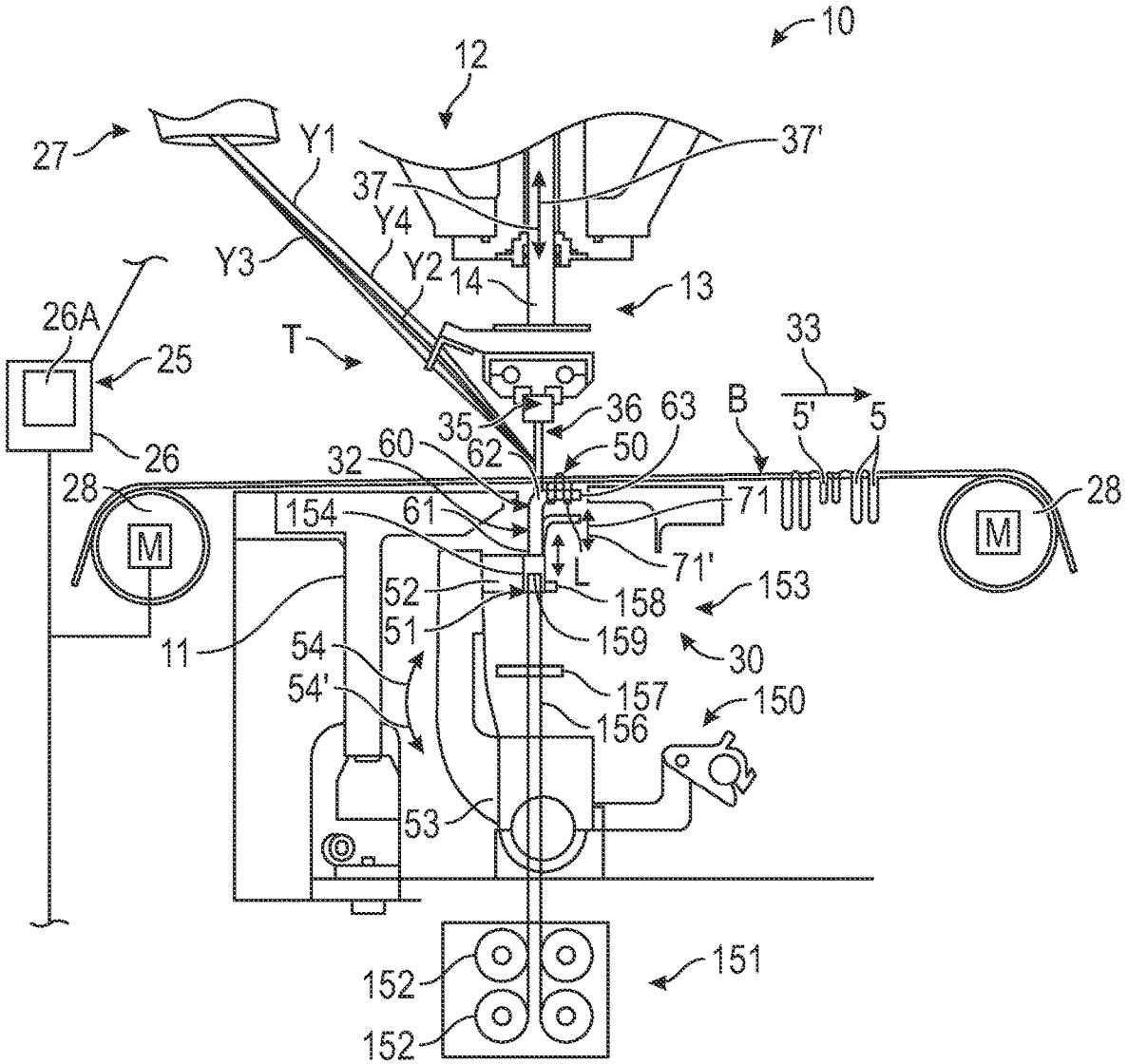
FIGS. 7A-7D illustrate an embodiment of a drive system and connector assembly for controlling movement of the gauge parts according to principles of the present disclosure.
Figure 7B:
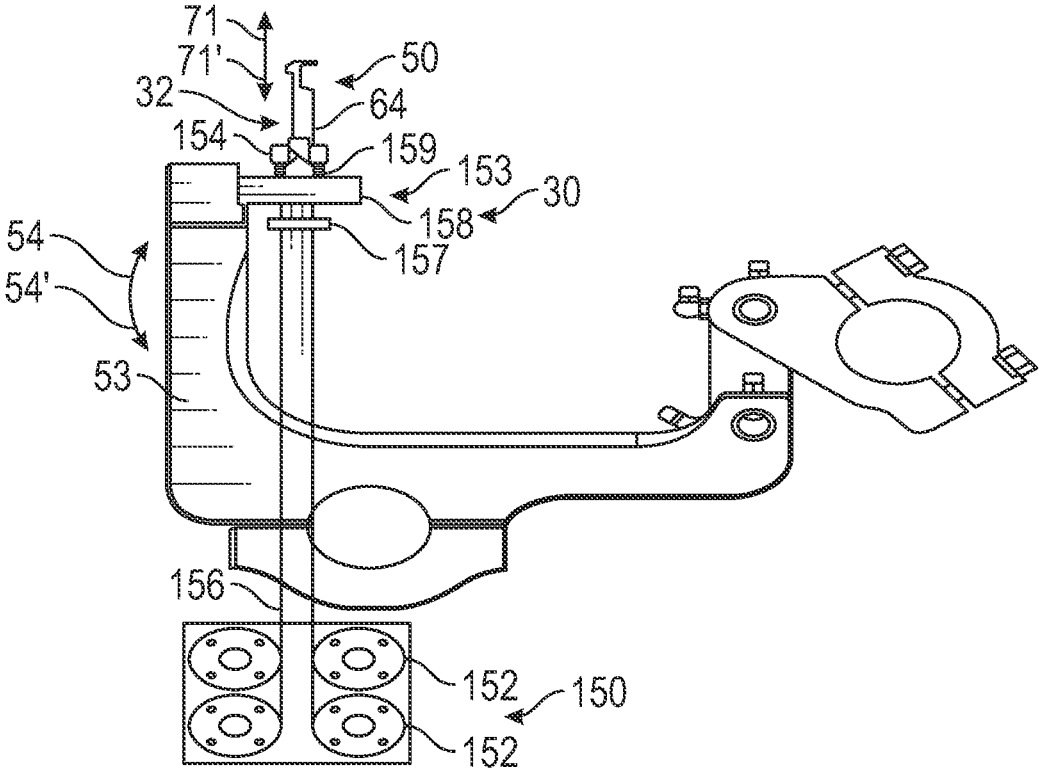
Figure 7C:
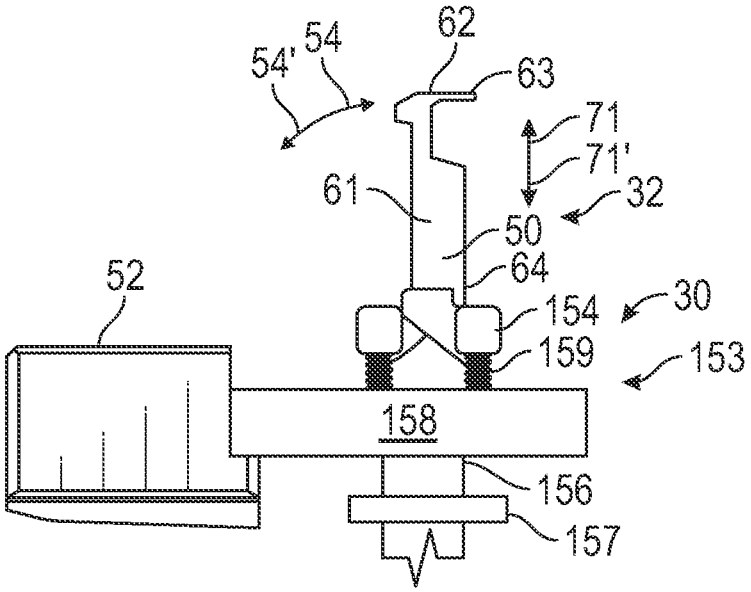
Figure 7D:
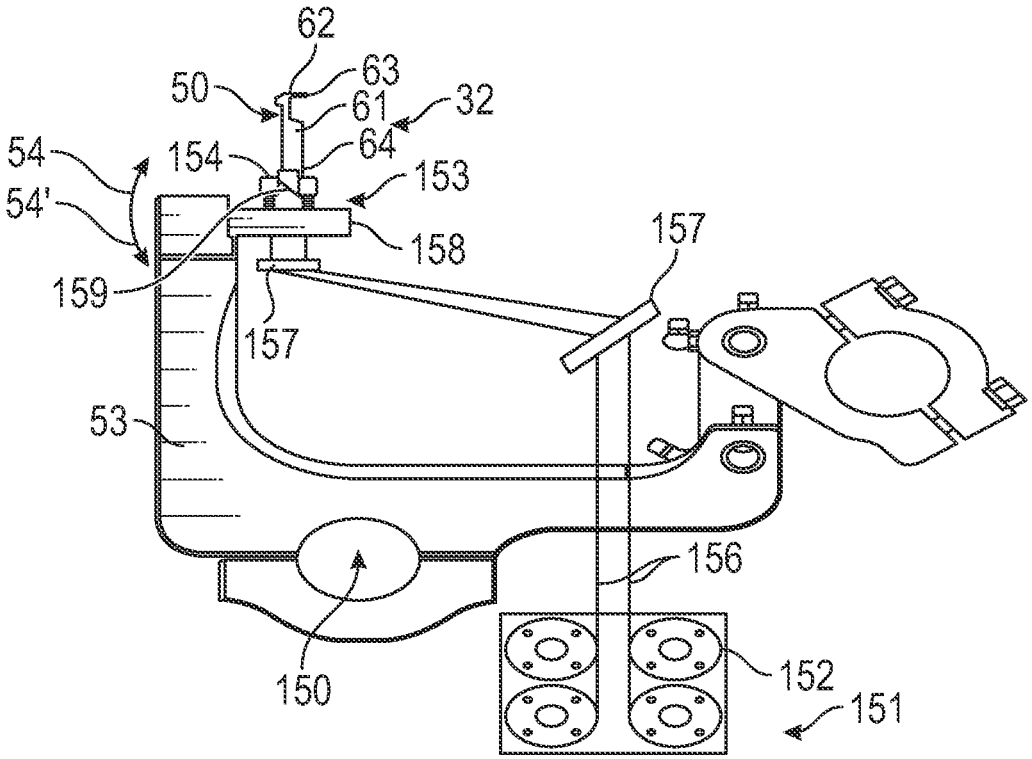

In FIGS. 7A and 7C-7D, the actuators 151 of drive system 150 are shown as including a series of motors 152, arranged below the drive arm or mechanism 53 (FIG. 7A) that carries the gauge parts 32, such as loopers or hooks 50 (or other gauge parts) in their reciprocating motion in a first direction indicated by arrows 54 and 54', toward and away from engagement with the needles as the needles 36 are reciprocated into and out of the backing material. The motors 152 can include servo or stepper motors or other programmable motors (as well as programmable drive mechanisms or actuators including electric cylinders, linear actuators or moving coil or voice coil actuators that can eliminate or reduce the need for compressors to supply a fluid for driving movement of the gauge parts); and will be coupled to corresponding or associated ones of the loopers or hooks 50 by connector assemblies 153.

As illustrated in FIGS. 7B-7C, each of the connector assemblies 153 will include a gate or connector 154 that can be connected to or which will receive the lower or distal end 64 of a gauge part. Each gate or connector 154 further will be connected to one or more of the motors 152 via a linkage 156, such as a cable, rod, wire, belt, or other similar connector. In some embodiments, a pair of linkages 156 can be connected to each gate or connector 154. It will, however be understood by those skilled in the art that a single linkage or multiple linkages can be used to connect each of the gauge parts to an associated or corresponding one of the motors 152.

As further indicated in FIGS. 7B-7D, in embodiments, the linkages 156 can extend through one or more guides 157, and through a spring plate or support 158. Biasing members 159 can be mounted between the distal ends of the connectors and the spring plate 158. The biasing members can include springs such as compression springs, wave springs or other, similar biasing members, including cylinders; and will be positioned such that as the linkages for selected gauge parts are retracted, their corresponding gauge parts are pulled or lowered toward a retracted position, and the biasing members will be compressed. As tension in the linkages is released, such as by reversing operation of the motors connected thereto, or otherwise disengaging the linkages from driven engagement with their motors, the biasing members will exert a biasing force against the gates or the gauge parts such that as the biasing members decompress, they will urge the gauge parts along their second direction, such as moving the gauge parts toward an extended position or raised elevation.

The motors 152 further can be controlled by the system controller to maintain a desired tension in the linkages, as may be needed to counter the biasing force exerted by the biasing members and control of the movement and/or positioning of the gauge parts with respect to the needles. Still further, the motors can be controlled by the control system in conjunction with control of the yarn feed to additionally cause movement of the gauge parts between raised and lowered positions with a captured a loop of yarn thereon, so as to further enable variations in the pile heights of tufts of yarns formed thereby. Additionally, the biasing force applied by the biasing members can be used to help control the movement of the gauge parts in their second direction, e.g. can help control the movement of the gauge parts between lowered and raised positons by the motors 152.

In some embodiments, the linkages can include substantially rigid rods, wires, arms, or other, similar connecting members, and the motors can be controlled to move the linkages in opposite directions to control movement of the gauge parts along a path in the second direction as they are reciprocated toward and away from the needles in the first direction. In such an embodiment, the biasing members may or may not be used.

Figure 8A:
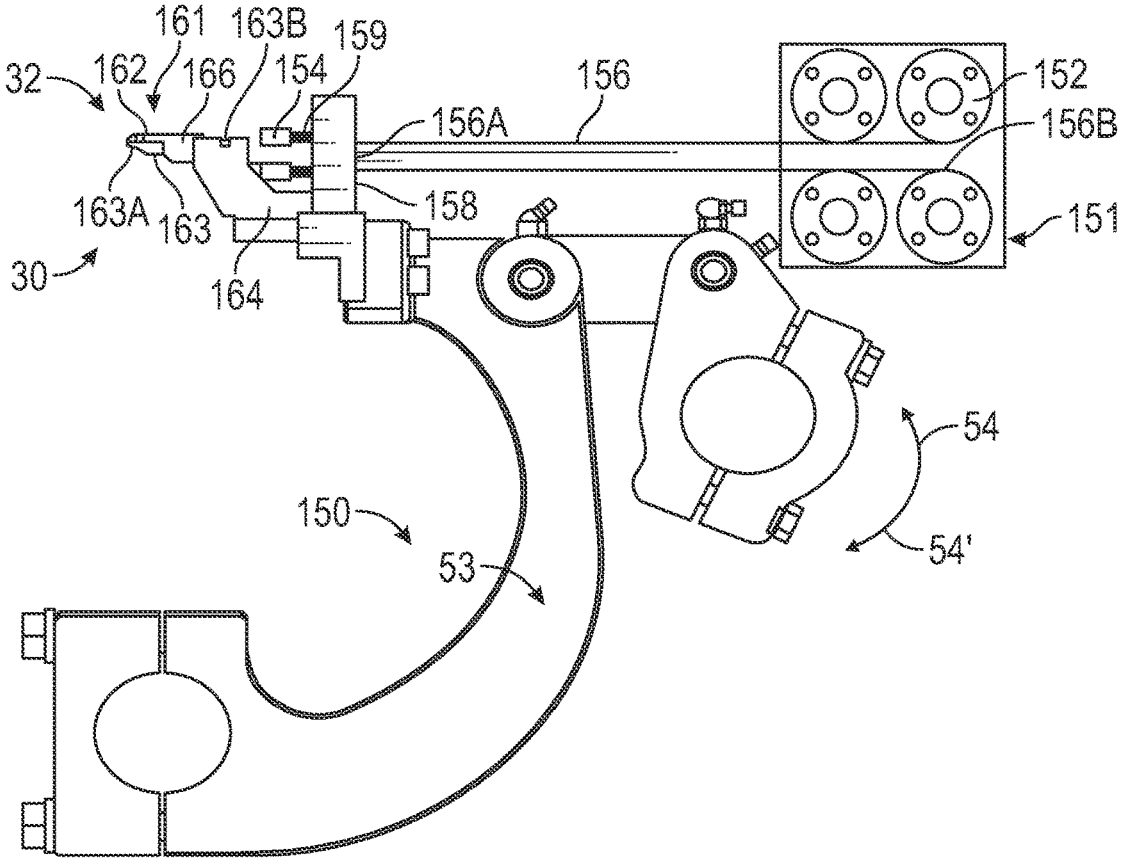
FIGS. 8A-8B are side views illustrating an example variation of the embodiment of a drive system and connector assembly for controlling movement of the gauge parts of FIGS. 7A-7D.
Figure 8B:
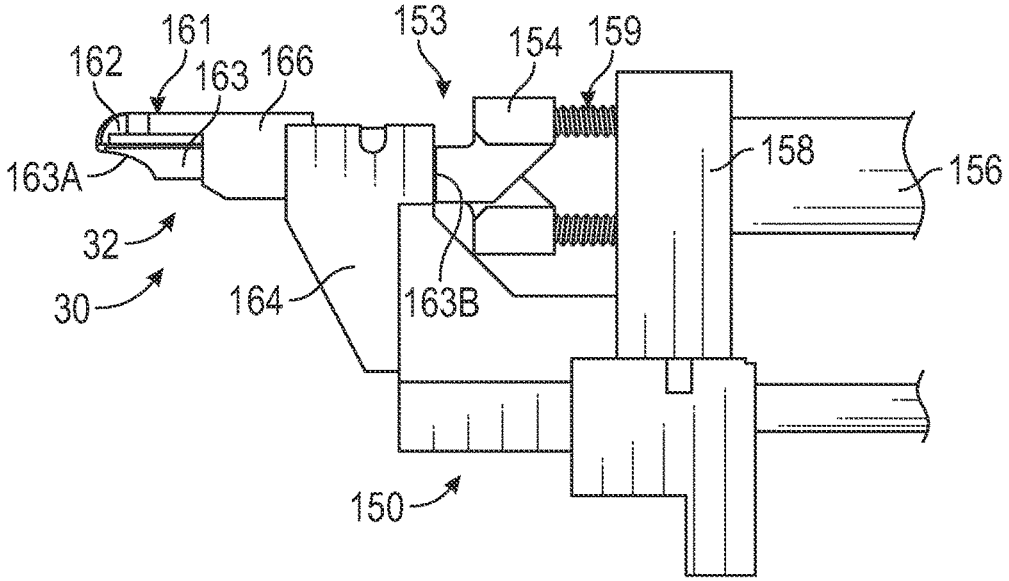

FIGS. 8A and 8B illustrate a variation of the drive system 150 shown in FIGS. 7A-7D. In FIGS. 8A-8B, the gauge parts 32 are shown as including level cut loop loopers 161, including a looper or hook body 162 with an extensible clip 163. In this embodiment, the level cut loop loopers 161 can each be mounted within a module or gauge block 164 mounted along the arm or drive mechanism 53 that reciprocates the level cut loop loopers toward and away from the needles in a first direction of movement. Each of the clips 163 of each of the level cut loop loopers 161 generally will include an elongated body 166 having a first or proximal end 163A and a second or distal end 163B. The distal end of each of the clips further generally will be received within a gate or connector 154 of a connector assembly 153. Biasing members 159 generally can be positioned between a distal or rear end of the each of the gates or connectors 154 and the spring plate 158 such as discussed with respect to the embodiment of FIGS. 7A-7D. Each connector assembly 153 further will include one or more linkages 156, such as cables, rods, wires, belts, arms, etc. that extend through the spring plate, and which can extend through the biasing members, and can be coupled at one end 156A to the distal end of each of the gates, and at an opposite end 156B to one or more motors 152.

In addition, in the embodiment shown in FIGS. 8A-8B, the actuators 151 can be oriented to the side of the level cut loop loopers. In such an embodiment, the linkages will extend laterally and will be coupled to the motors and the gates for the clips of the level cut loop loopers.

In operation of the drive system 150; as shown in FIGS. 8A and 8B, as the level cut loop loopers 161 are reciprocated toward and away from the needles of a tufting machine, in a first direction, the clips of the level cut loop loopers further can be selectively controlled, so as to extend or retract the clips as needed to form cut or loop pile tufts. For example, as the level cut loop loopers are reciprocated toward the needles, such as in a path shown by arrows 54/54 in FIG. 7A, the clips for their selected ones of the level cut loop loopers can be retracted by control of the motor or motors linked thereto to move the linkages 156 along a path of movement in the second direction to retract or extend the clips (FIG. 8A). With the clips in the retracted position, the level cut loop loopers can pick up and retain loops of yarns thereon for forming cut pile tufts.

Thereafter, the motors can be reversed or disengaged from the linkages so as to allow biasing force exerted by the biasing members against the gates to cause the clips connected thereto to return to an extended position, moving along the body of their level cut loop looper, and into a position to block the capture of loops of yarns by the level cut loop looper such that any loops of yarns picked up thereby will be released to form loop pile tufts. The biasing force applied by the biasing members further can be used in conjunction with the operation of the motors or other actuators to help control the movement of the gauge parts in their second direction, e.g. can help control the movement of each of the gauge parts between various lowered and raised positons in smaller and/or more defined increments or distances.

In addition, the control system for the tufting machine will include programming for controlling the yarn feed to each of the needles in conjunction with the operation of the level cut loop loopers and their clips so as to control a length of loops of yarns picked-up or captured by the gauge parts to form various pattern effects such as discussed further below.

Figure 9A:
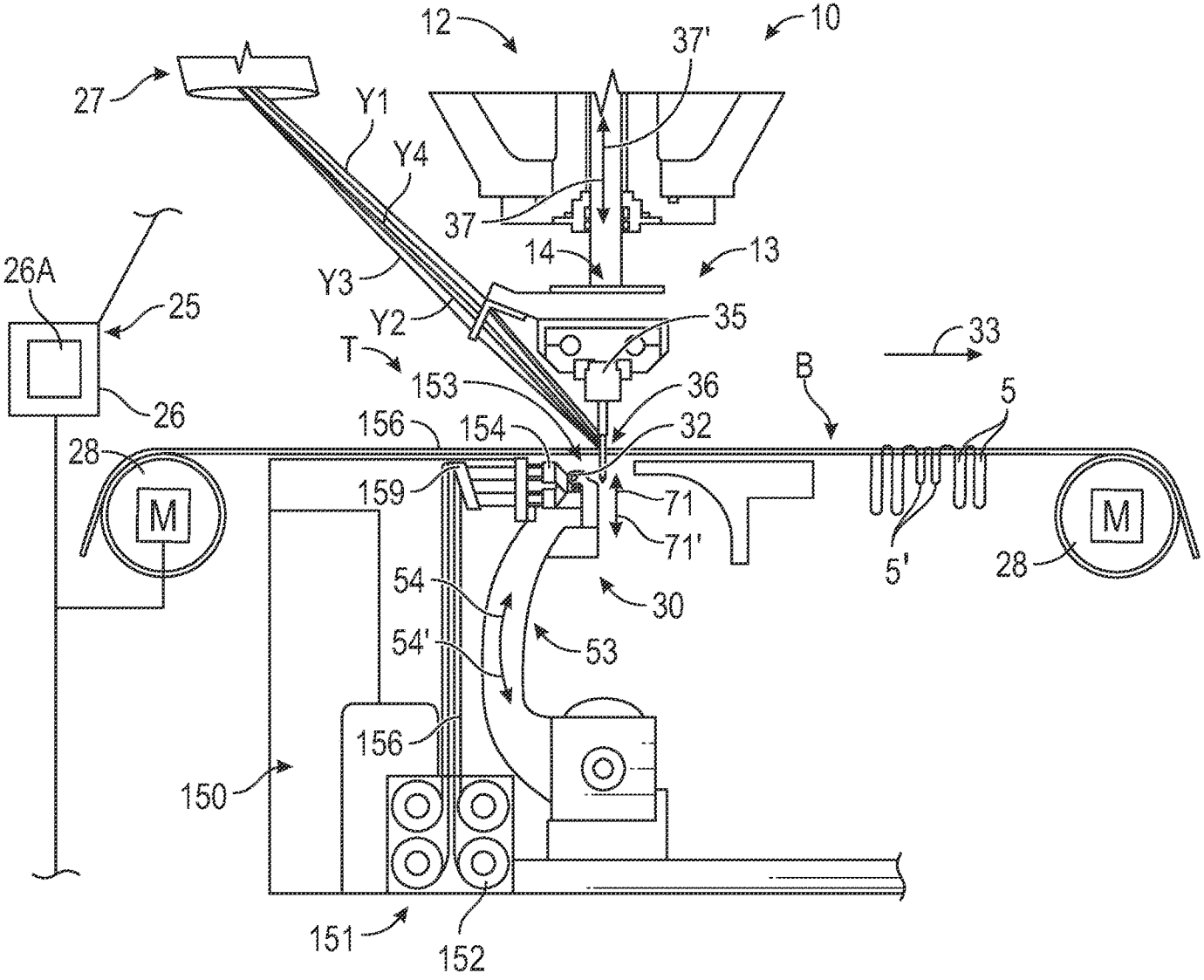
FIGS. 9A-9C illustrate a further an embodiment of a drive system and connector assembly for controlling movement of the gauge parts according to principles of the present disclosure.
Figure 9B:
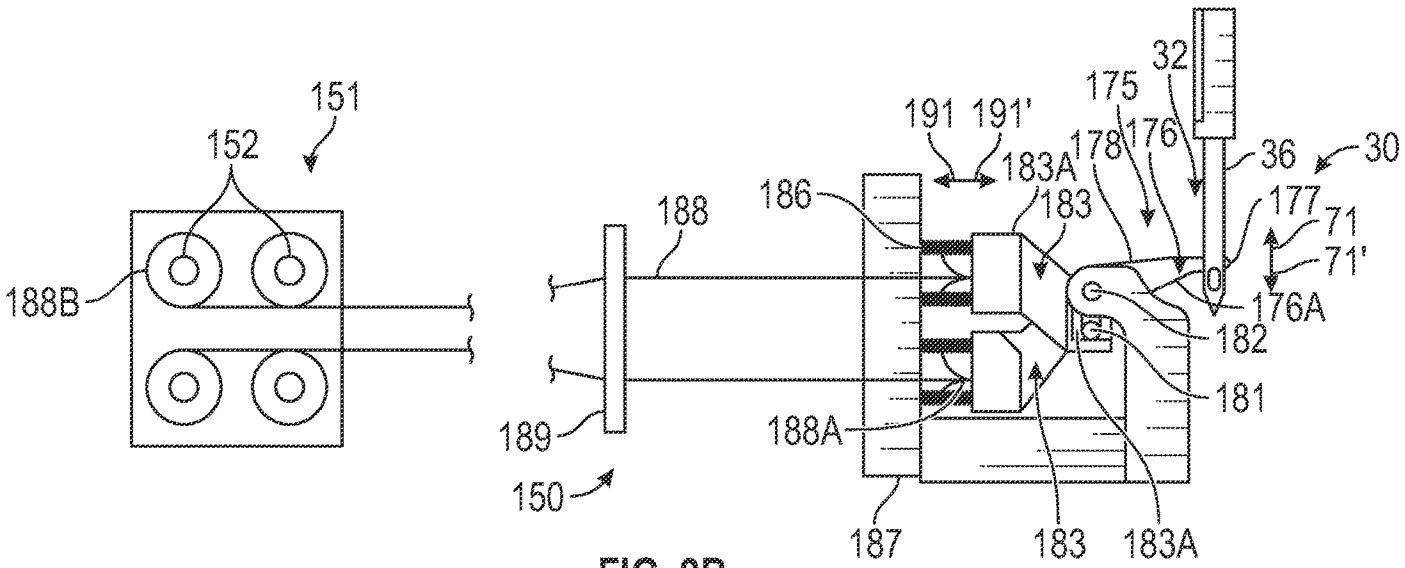
Figure 9C:
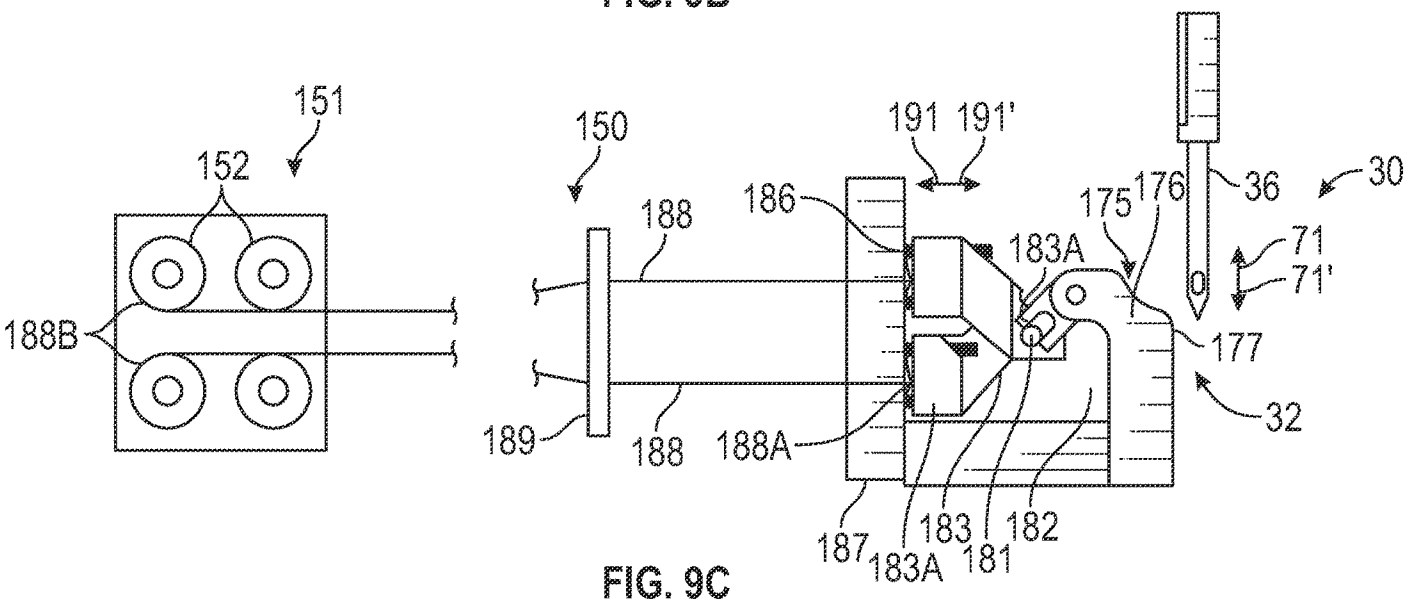

FIGS. 9A-9C illustrate a further variation or embodiment of drive system 150 for the selective control of the positioning of the gauge parts 32 of a tufting machine. As indicated in FIGS. 9B and 9C, the gauge parts 32 can include loopers, hooks, or other gauge parts, with an elongated body 175 with a first or proximal end 176 defining a throat 176A and terminating at a point or bill 177, and a second, distal end 178 pivotally attached to a holder or module 179. The second or distal end 178 of each of the gauge parts further can include a slot or recess 181 configured to engage or receive a mating pin or other connector 182 located at a first or proximal end 183A of a gate or connector 183 of the connector assembly 153. The connector assembly 153 further can include biasing members 186, such as springs, etc., arranged between the second or distal end 184 of each of the gates or connectors 183 and a spring plate or support 187; with linkages 188 connecting the gates or connectors holding the gauge parts to corresponding or associated actuators 151.

The linkages 188 can include cables, rods, wires, belts or other, similar connectors, and, in embodiments, will extend through the spring plate and each will connect to the distal end 183B of one of the gates or connectors 183 at a first end 188A, and can connect to a corresponding actuator 151, such as one or more motors 152 (e.g., servo motors, stepper motors, torque motors, moving coil actuators, linear actuators, electric cylinders, etc.) at a second end 188B. The linkages further can be extended through one or more guides 189 as needed to help control movement and/or tension in the linkages. As indicated in FIGS. 9A-9B, as the gauge parts are reciprocated toward and away from the needles 36 in a first direction, the actuators connected to corresponding or associated ones of the gauge parts can be selectively controlled by the control system such that the linkages for the selected gauge parts can be retracted or extended. As the linkages are retracted, the gates connected thereto will be pulled rearwardly against one or more biasing members 186, toward the spring plate 187 in the direction of arrow 191, and generally causing compression of the biasing members. In response, the gauge parts generally will be pivoted or moved in a second direction toward a retracted or lowered position, as indicated at arrow 71' in FIG. 9C.

Upon disengagement of the linkages, or reversing of the actuators (e.g., reversing of motors or release of the linkages thereby), the biasing force exerted by the biasing members as they are decompressed will cause these gates to be urged forwardly in the direction of arrow 191', which in turn can cause the gauge parts to pivoted in a reverse direction, as indicated by arrow 71, causing the first or proximal ends thereof to be raised toward an extended or elevated position for engaging the needles and picking loops of yarn or a loop of yarns therefrom. The control system can control the actuators to provide a counter to the biasing force from the biasing members to control the movement and/or positioning of the gauge parts to an extended position. The actuators further can be controlled by the control system in conjunction with control of the yarn feed to additionally cause the movement of the first or proximal ends of the gauge parts between the raised and lowered positions with a captured a loop of yarn thereon, so as to further enable variations in the pile heights of tufts of yarns formed thereby.

Figure 10B:
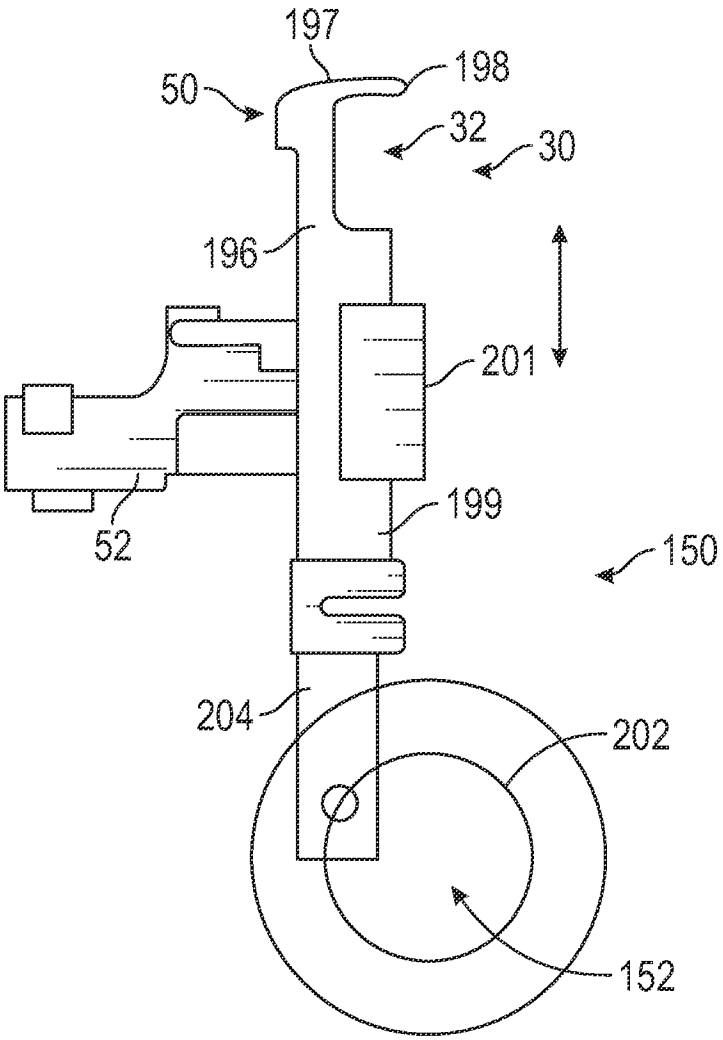
FIGS. 10A-10B illustrate another embodiment of a drive system and connector assembly for controlling movement of the gauge parts according to principles of the present disclosure.
Figure 10A:
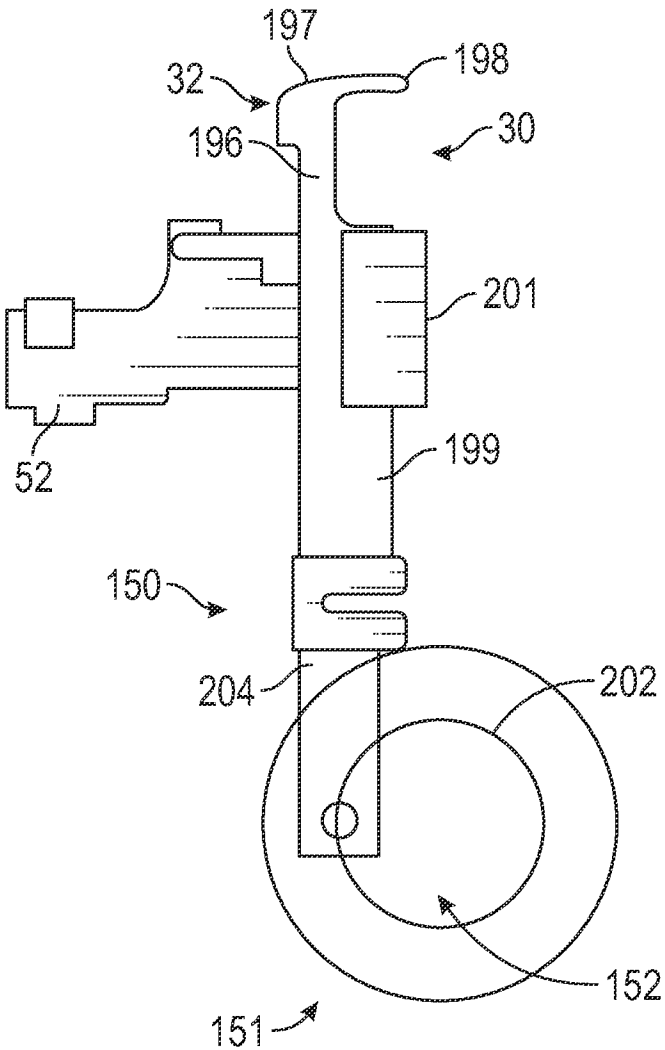

FIGS. 10A and 10B illustrate another variation of drive system 150 for controlling movement of gauge parts 32 in a second direction in addition to movement of the gauge parts in a first direction toward and away from the needles of a tufting machine. As illustrated in FIGS. 10A and 10B, each of the gauge parts 32 (here shown as including loopers or hooks 50) can have an elongated body 196 with an upper end 197 including an elongated throat that projects toward the needles and terminates in a bill or tip 198, and a lower or distal end 199 that projects through a module or holder 201, and can be coupled to a drive member 202 connected to an actuator 151. In this embodiment, the actuators can include motors 152 such as servo motors, stepper motors, torque motors, and other types of motors, although cylinders or drive mechanisms also can be used. In addition, in some embodiments, the lower, distal end of each of the gauge parts can be coupled or connected to a linkage or extension piece 204 that can be coupled to the drive member of the associated or corresponding actuator.

In embodiments, the drive members 202 can include eccentrics, pulleys, or disks, or other rotatable drive members. The drive members can be driven by the actuators in a rotary movement; and, as the drive members are rotated, the linkages coupled thereto will be extended or retracted, such that the gauge parts will be moved in a substantially linear motion, in their second direction. The throats of the gauge parts thus will be moved between extended or raised positions and retracted, lowered positions, including being moved to a fully lowered, no-sew position wherein the throats of the gauge parts generally will not engage in pick up loops of yarns from the needles. As the drive members are further rotated by the actuators, either in a reverse direction or toward a generally complete rotation, the gauge parts can be returned to desired elevations or positions with respect to the needles.

Figure 11A:
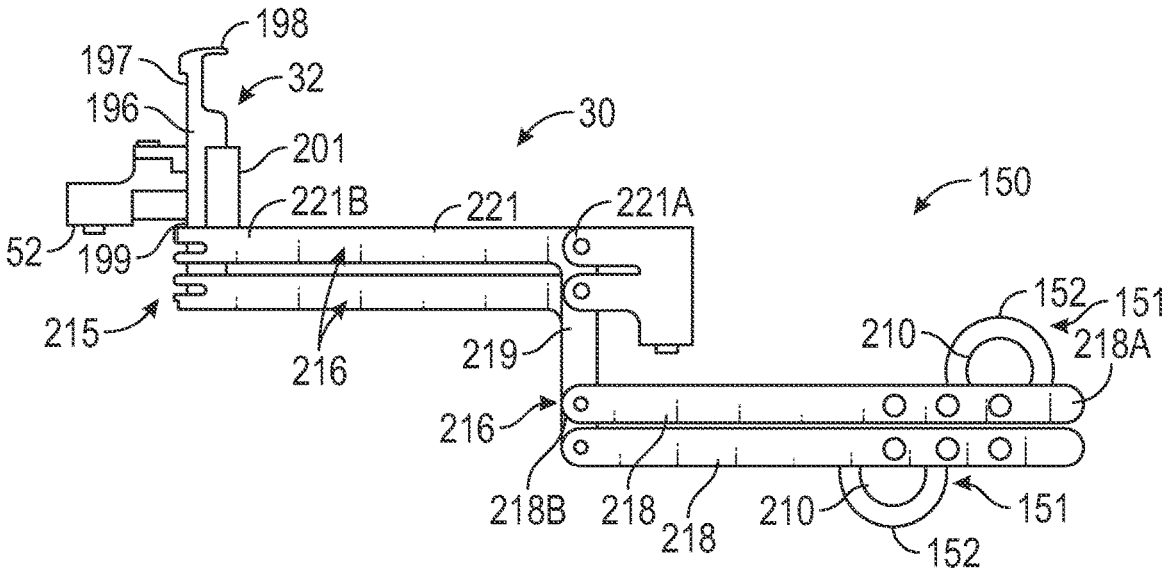
FIGS. 11A-11B illustrate another embodiment of a drive system and connector assembly for controlling movement of the gauge parts according to principles of the present disclosure.
Figure 11B:
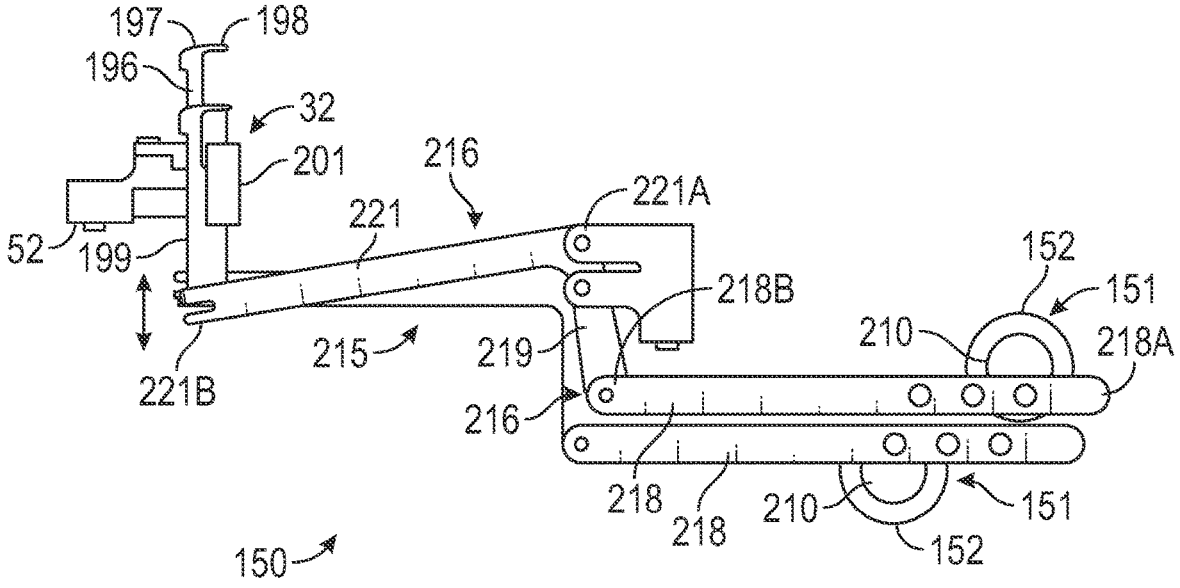

FIGS. 11A-11B illustrate still a further variation or embodiment of a drive system 150 for controlling movement of gauge parts 32 of a tufting machine, to control or adjust the position or elevation of the gauge parts with respect to the needles of the tufting machine, by movement of the gauge parts in second direction with respect to the stroke of the needles (e.g., in a vertical or up and down movement) as the needles are reciprocated toward and away from the needles in a first direction, such as illustrated in FIGS. 2, 7A and 9A and discussed above. In the embodiment illustrated in 11A-11B the drive system 150 generally will include actuators 151 such as motors 152 such as servo motors, stepping motors, torque motors, or other types of motors, although cylinders or other drive mechanisms also can be used. Each motor further can include a rotatable drive member 210 coupled thereto. The drive members 210 can include eccentrics, pulleys, cams or other, similar drive members, coupled to the motors so as to be rotated in an eccentric motion.

Connector assemblies 215 connect the gauge parts to corresponding or associated ones of the actuators, with the connector assemblies including linkages 216. In the present embodiment, the linkages, are illustrated as including rods, arms, bars or sections. Other types of linkages also can be used. As indicated in FIGS. 11A and 11B, the linkages can include a first arm 218 connected at one end 218A to the drive member of an associated or corresponding one of the actuators, and at an opposite end 218B to an intermediate arm 219, which in turn is pivotally connected to a second arm 221 at a first or proximal end 221A thereof; and with a second or distal end 221B of the second arm engaging or connected to a lower or distal end 222 of a corresponding or associated one of the gauge parts. As indicated in FIG. 11B, rotation of the drive members will cause the first arm of the associated linkage to be extended or retracted in the direction of arrows 223/233', which in turn will cause the pivoting movement of each of the second arms of such linkages. This in turn will cause the corresponding or associated gauge part connected to the distal end of second arm to be moved in its second direction so as to position the bill or throat of the gauge part at a selected location or elevation with respect to the stroke of the needles as the needles penetrate the backing.

In operation, according to some embodiments, tufted articles can be formed according to the system and method of the present disclosure, which tufted articles can be formed with various patterns and pattern effects, including the use of multiple different color and/or type yarns for forming such patterns, as well as including sculptured or multiple pile height effects. For example, the system and method of the present disclosure can be operated in conjunction with a stitch distribution control system or yarn color placement system such as disclosed and illustrated in U.S. Pat. Nos. 8,141,505, 8,359,989 and 8,776,703, the disclosures of which are incorporated by reference as if set forth fully herein.

In such embodiments, the stitches or tufts of yarns being formed in the backing material further can be formed at an increased or higher actual operative or effective process stitch rate as compared to the fabric or pattern stitch rate that is desired or prescribed for the tufted pattern being formed. If the pattern or fabric stitch rate or density of a pattern being formed calls for the tufted article to have an appearance of 8, 10, 12, etc., stitches per inch formed therein, and/or which are to be shown on its face, the actual, operative or effective number of stitches per inch formed during operation of the tufting machine will be substantially greater than the desired or prescribed pattern or fabric stitch rate. Thus, the actual formation of stitches or tufts of yarns in the backing material will be accomplished at an increased actual, operative or effective process stitch rate, whereby effectively, a greater number of stitches per inch than will be required to be shown in the finished pattern will be formed in the backing material, with those stitches or face yarns that are not desired to be shown or remaining in the face of the pattern field or area being sewn not being picked-up by gauge parts, and in some cases, being pulled back and out of the backing material or to an extent to enable such yarns to be held or tacked in the backing while substantially avoiding creation of undesired or unnecessary gaps or spaces between the retained or face yarns of the pattern (i.e., the tufts of yarns that are to remain visible or appear in the finished pattern of the tufted article).

For purposes of illustration, in one example embodiment, the effective process stitch rate can be based upon or determined by increasing the fabric or pattern stitch rate of the pattern being formed approximately by a number of colors selected or being tufted in the pattern. For a pattern having a desired fabric or pattern stitch rate of about 10-12 stitches per inch, and which uses between 2-4 colors, the effective or operative process stitch rate (i.e., the rate at which stitches are actually formed in the backing material) can be approximately 18-20 stitches per inch up to approximately 40 or more stitches per inch. However, it further will be understood by those skilled in the art that additional variations of or adjustments to such an operative or effective process stitch rate run for a particular pattern can be made, depending upon yarn types and/or sizes and/or other factors. For example, if thicker, larger size or heavier yarns are used, the effective process stitch rate may be subject to additional variations as needed to account for the use of such larger yarns (e.g., for 4 color patterns, the effective process stitch rate can further vary, such as being run at about 25-38 stitches per inch, though further variations can be used as needed). Thus, where a selected or programmed pattern being run may be designed or desired to have ten to twelve stitches per inch as a desired pattern density or stitch rate therefor, the system may actually operate to form upwards of twenty to forty-eight or more stitches per inch, depending on the number of colors and/or types of yarns, even though visually, from the face of the finished tufted article, only the desired/selected ten to twelve stitches generally will appear.

Additionally, where a series of different colors are being tufted, the needles 36 of the needle bar 35 generally will be provided with a desired thread up, for example, for a four-color pattern an A, B, C, D thread up can be used for the needles. Alternatively, where 2 needle bars are used, the needles of each needle bar can be provided with alternating thread up sequences, i.e., an A/C thread up on the front needle bar, with the rear needle bar threaded with a B/D color thread up. In addition, the needles of such front and rear needle bars can be arranged in a staggered or offset alignment. The needle bar or needle bars further generally will be shifted by control of the needle bar shifter 40 (FIG. 2) in accordance with a shift profile for the pattern being formed, in conjunction with the control of the backing material and control of the yarn feed so as to effectively present each one of the colors (i.e., 2, 3, 4, 5, etc.) of yarns or each different type of yarn that could be sewn at a selected pattern pixel or tuft/stitch location to the looper or hook by shifting of the needle bar transversely with respect to the backing material as the backing material is fed through the tufting zone.

For example, for a four color pattern, each of the one-four colors that can be sewn at a next pixel or stitch location, i.e., one, two, three, four, or no yarns can be presented at a selected pixel or stitch location, will be presented to a desired looper or hook as the backing material is moved incrementally approximately ⅛th-¼0th of an inch per each shift motion or cam movement cycle. The loopers or hooks will engage and form loops of yarns, with a desired yarn or yarns being retained for forming a selected tuft, while the remaining yarns generally can remain with their needles without being picked-up by a looper or hook. Some yarns can be picked up as needed and the yarn feed mechanism(s) therefor can be controlled, including pulling these non-retained yarns pulled out of the backing material so as to float along the backing material. Accordingly, each looper or hook is given the ability to tuft any one, or potentially more than one (i.e., 2, 3, 4, 5, 6, etc.,) of the colors of the pattern, or possibly none of the colors presented to it, for each pattern pixel or tuft/stitch location associated therewith during each shift sequence and corresponding incremental movement of the backing material. As noted, if none of the different type or color yarns is to be tufted or placed at a particular tuft or stitch location or pixel, the yarn feed can be controlled to limit or otherwise control the yarns of the needles that could be presented at such stitch location or pixel to substantially pull back all of the yarns or otherwise prevent such yarns from being placed or appearing at that stitch location, and/or the needle bar additionally could be controlled so as to jump or otherwise bypass or skip presentation of the needles/yarns to that stitch location or pixel.

The feeding of the backing material B further can be controlled, i.e., by the stitch distribution control system in a variety of ways. For example, the tufting machine backing rolls 28 can be controlled to hold the backing material in place for a determined number of stitches or cycles of the needle bar, or can move the backing material at a desired number of stitches per inch, i.e., move about 1/40th of an inch for each penetration, or variations thereof so as to move about 1/10th of an inch as four stitches are introduced in the backing for a pattern with four colors and an effective stitch rate of 40 stitches per inch. The movement of the backing material further can be varied or manipulated on a stitch-by-stitch or pixel basis with the average movement of all the stitches over a cycle substantially matching the calculated incremental movement of the operative or effective process stitch rate. For example, for a 4-color cycle, a first stitch can be run at 1/80th of an inch, the next two at 1/40th of an inch, and the fourth at 1/20th of an inch, with the average movement of the backing over the entire 4-stitch cycle averaging 1/40th of an inch for each stitch presented, as needed, to achieve a desired stitch/color placement.

Each different yarn/color yarn that can be tufted at a particular stitch location or pixel thus can be presented to such stitch locations or pixels as the pattern is formed in the backing material. To accomplish such presentation of yarns at each pixel or stitch location, the needle bar(s) generally can be shifted as needed/desired per the calculated or selected cam profile or shift profile of the pattern to be run/formed, for example, using a combination of single and/or double jumps or shifts, based on the number of colors being run in the pattern and the area of the pattern field being formed by each specific color. Such a combination of single and double shift jumps or steps can be utilized to avoid over-tufting or engaging previously sewn tufts as the needle bar is shifted transversely and the backing material is advanced at its effective or operative stitch rate. The backing also can be shifted by backing or jute shifters, etc., either in conjunction with or separately from the needle bar shifting mechanism.

As the needles penetrate the backing B, as indicated in FIGS. 1 and 2, the loopers or hooks 50 of the gauge part assembly 30 will be reciprocated toward the needles, in the direction of arrow 54 so as to engage and pick or pull loops of yarns from their associated or corresponding needles. In addition, the actuators 66 for the loopers or hooks can be selectively controlled and engaged so as to cause selected ones of the loopers or hooks to be extended or retracted so that the bills 63 and throat portions 62 thereof are located at a desired position with respect to the needles as the needles 36 penetrate and complete their stroke into and out of the backing.

As indicated in FIGS. 5A-6C, the location or positioning of the bills and/or throat portions of the loopers or hooks can be varied between a fully extended position or elevation and a lowered or retracted, "no-sew" position at which loops of yarns generally can be substantially prevented from being picked up and/or formed by such loopers or hooks to provide a selective pick-up of loops of yarns, including no loop(s) of yarns being picked up, and control of the lengths of the loops of yarns that are selectively picked up from the yarns presented at each of the stitch locations or pixels in accordance with the instructions for the pattern being formed. As a result, the locations at which the loops of the selected or desired face yarns to be shown in the "finished" pattern are picked up from the needles by the loopers or hooks can be controlled, with the formation of the resultant tufts from such picked up loops of yarns remaining within the backing further being controlled so as to be able to be formed at a variety of different pile heights.

The type/color of yarn of each series of yarns being presented at each pixel or stitch location that is to be retained or shown on the face of the backing at a particular stitch location generally will be determined according to the pattern instructions or programming for the formation of the tufted pattern. Controlling the activation and/or positioning of the loopers or hooks 50 corresponding to or associated with the needles carrying such yarns can enable the tufting machine to selectively pick-up and retain a loop of that yarn at each stitch location at which such yarns are to remain in accordance with the pattern, so as to form a resultant tuft of such a yarn at a selected pile height. For example, if the presented yarn is not to be shown or appear, the corresponding looper or hook can be retracted to a no-sew position so that a loop of yarn is not picked-up, and the yarn feed therefor controlled so that such a yarn is not retained at the pixel or stitch location. For the retained yarns/colors, i.e., the yarns appearing on the face of the patterned tufted article, the positions or elevations of the loopers or hooks and the yarn feed mechanisms feeding these yarns generally can be cooperatively controlled so as to enable pick-up and formation of loops of such yarns sufficient to form tufts of a desired type and pile height.

The further control of the backing feed at an increased effective or operative process stitch rate (e.g., the actual rate at which stitches are formed in the backing) in accordance with the principles of the present disclosure further provides for a denser or compressed field of stitches or tufts per inch, so that the yarns that are not picked-up can be removed at least to an extent sufficient to tack or hold such yarns against the backing as needed, without creation of undesired spaces or gaps between the retained face yarns (those appearing on the face of the tufted article according to the pattern) and interfering with or showing through such retained face yarns formed in the backing material. Additionally, the control system can perform yarn feed compensation and/or modeling of the yarn feed to help control and reduce the amount of non-retained or non-appearing yarns that may be "floating" on the back side of the backing material to further help reduce/minimize excess yarn feed and/or waste.

In addition, the yarn feed mechanisms controlling the feeding of each of the yarns to each of the needles can be selectively controlled to pull the yarns carried by the needles substantially out of the backing material or with the reciprocation of the needles; and can retract or pull back/low some loops of yarns to a position substantially low enough to generally avoid such non-selected ends of yarns occupying a selected stitch location, or otherwise interfering with the placement of a selected face yarn or yarn to be shown in a particular color field being formed according to the pattern.

For example, in some embodiments, when selected or particular loopers or hooks are retracted to a fully retracted position or "no sew" position, no loop generally will be picked up from the needles associated with such fully retracted loopers or hooks, while the yarn feed is correspondingly controlled so that the yarns are allowed to move with their needles into and back out of the backing material. In addition, in some instances where loops of yarns are formed, such as when the loopers or hooks are at a fully extended position and form low loops, the resultant formed loops of yarns further can be back-robbed or pulled substantially low or out of the backing material by control of the yarn feed thereof to an extent so as to leave an amount of yarn engaged with or "tacked" to the backing, while substantially removing such yarns to an extent so that such non-selected ends of yarns generally will not interfere with the placement of a face appearing or selected yarn at a particular stitch location within the color field being sewn.

The placement of the non-appearing yarns being tacked or otherwise secured to the backing material also can be controlled to prevent the formation of such extended length tails that can later become caught or cause other defects in the finished tufted article. For example, the control system also can be programmed/set to tack or form low stitches of such non-appearing yarns at desired intervals, e.g., every 1 inch to 1.5 inches, although greater or lesser intervals also can be used. Yarn compensation also generally can be used to help ensure that a sufficient amount of yarns is fed when needed to enable the non-appearing yarns to be tacked into the backing material, while preventing the yarns from showing or bubbling up through another color, i.e., with the yarns being tacked into and projecting through one of the stitch yarns with several yarns being placed together. Additionally, where extended lengths or tails would be formed for multiple non-appearing yarns, the intervals at which such different yarns are tacked within the backing material can be varied (i.e., one at 1", another at 1.5", etc.) so as to avoid such tacked yarns interfering with one another and/or the yarns of the color field being formed.

Still further, the actuators, such as the actuators 66 of FIGS. 1-6C and 151 of FIGS. 7A-11B, also can be controlled to vary the positon, location and/or elevation of the gauge parts with respect to the needles to not only enable pick-up of loops or yarns or no pick-up of loops of yarns, but also to enable pick-up of different lengths of loops of yarns by the gauge parts. In embodiments, the location and movement of the gauge parts can be incrementally controlled, in conjunction with the control of the yarn feed mechanisms, to cause the formation of extended or elongated loops of yarns, such as by being engaged and retracting or lowering their respective loopers or hooks with a loop of yarn captured thereon. The captured loops of yarns thus can be further pulled and/or elongated, while the corresponding yarn feed for such yarns also can be controlled for to feed additional amounts of such yarns as needed. As a result, even longer or greater length loops of yarns can be formed in the backing so as to create higher pile tufts and/or for creating other desired pattern effects, such as for tip shearing and/or other patterning features.

The selective control of the actuators for selectively retracting and extending their loopers or hooks further can be used to provide additional variation or transitioning steps or pile heights within a pattern. For example, the gauge parts can be moved incrementally with respect to the needles by control of their actuators alone or in relation to the biasing force applied by the biasing members to buffer and/or enable control of the movement of the gauge parts in smaller increments as needed to provide more gradual or subtle differences or changes in pile heights, or for providing more dramatic or defined separations between pile heights of the tufts of yarns being formed.

Accordingly, across the width of the tufting machine, the control system will control the shifting and feeding of the yarns of each color or desired pattern texture effect so that each color that can or may be sewn at a particular tuft location or pattern pixel will be presented within that pattern pixel space or tuft location for sewing, but only the selected yarn tufts for a particular color or pattern texture effect will remain in that tuft/stitch location or pattern pixel. As further noted, it is also possible to present additional or more colors to each of the loopers or hooks during a tufting step in order to form mixed color tufts or to provide a tweed effect as desired, wherein two or more stitches or yarn will be placed at desire pattern pixel or tuft location. The results of the operation of the stitch distribution control system accordingly provide a multi-color visual effect of pattern color or texture effects that are selectively placed in order to get the desired density and pattern appearance for the finished tufted article. This further enables the creation of a wider variety of geometric, free flowing and other pattern effects by control of the placement of the tufts or yarns at selected pattern pixels or tuft locations.

The system and method for tufting sculptured and multiple pile height patterns articles of the present disclosure thus can enable an operator to develop and run a variety of tufted patterns having a variety of looks, textures, etc., at the tufting machine without necessarily having to utilize a design center to draw out and create the pattern. Instead, with the present disclosure, in addition to and/or as an alternative to manually preparing patterns or using a design center, the operator can scan an image (i.e., a photograph, drawing, jpeg, etc.) or upload a designed pattern file at the tufting machine and the stitch distribution control system can read the image and develop the program steps or parameters to thereafter control the tufting machine substantially without further operator input or control necessarily required to form the desired tufted patterned article.

The foregoing description generally illustrates and describes various embodiments of the present disclosure. It will, however, be understood by those skilled in the art that various changes and modifications can be made to the above-discussed construction of the present disclosure without departing from the spirit and scope of the present disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present disclosure. Accordingly, various features and characteristics of the present disclosure as discussed herein may be selectively interchanged and applied to other illustrated and non-illustrated embodiments of the present disclosure, and numerous variations, modifications, and additions further can be made thereto without departing from the spirit and scope of the present disclosure as set forth in the appended claims.

What is claimed:

1. A tufting machine, comprising:

at least one needle bar having a plurality of needles mounted therealong;

backing feed rolls feeding a backing material;

at least one yarn feed mechanism feeding yarns to the needles;

a plurality of gauge parts positioned below the backing material, each of the gauge parts including a body having a first portion and a second portion having a throat configured to pick-up loops of yarns from the needles;

wherein the gauge parts are moveable in a first direction toward and away from engagement with the needles, and in a second direction;

a drive system for movement of the gauge parts in their second direction, the drive system comprising:

a plurality of actuators; and a linkage coupled to each gauge part and to an associated actuator, wherein each linkage is retracted or extended by its associated actuator to cause movement the gauge part in the second direction;

a plurality of connectors configured to connect each gauge part to at least one linkage for an associated actuator, each of the connectors comprising a body having a first end along which the first portion of the body of one of the gauge parts is received, and a second end connected to the at least one linkage; and a series of biasing members located between the second end of each connector and a spring plate; and a control system including programming for controlling the at least one yarn feed mechanism to control feeding of the yarns to the needles in coordination with a selective actuation of one or more of the actuators so as to extend or retract the linkages coupled thereto to move selected gauge parts along the second direction between a no-sew position and an extended position with respect to a stroke of the needles into the backing material for engaging the needles and forming tufts of yarns in the backing material according to a pattern being formed.

2. The tufting machine of claim 1, further comprising a shift mechanism for shifting the at least one needle bar transversely across the backing material, and wherein the control system further comprises programming to coordinate shifting of the at least one needle bar by the shift mechanism, feeding of the backing material by said backing feed rolls, control of the actuators coupled to the gauge parts, and control of the at least one yarn feed mechanism feeding the yarns to the needles as the needles are reciprocated into and out of the backing material, so as to present a series of yarns to selected stitch locations along the backing material and withdraw non-selected yarns where loops of such non-selected yarns are not picked up by one of the gauge parts, and with the backing material moved through a tufting zone at an actual stitch rate that is greater than a pattern stitch rate for the pattern being formed to provide a number of retained tufts per inch of face yarns in the backing material that is approximately equivalent to the pattern stitch rate.

3. The tufting machine of claim 1, wherein the gauge parts comprise level cut loop loopers, loop pile loopers, or cut pile hooks.

4. The tufting machine of claim 1, wherein the actuators comprise hydraulic cylinders, pneumatic cylinders, stepper motors, servo motors, electric cylinders, linear actuators, moving coil or voice coil actuators, solenoids, or combinations thereof.

5. The tufting machine of claim 1, further comprising at least one module carrying a series of gauge parts in a reciprocating motion in a direction toward and away from engagement with the needles as the needles are reciprocated into the backing material; the at least one module comprising:

a module body adapted to mount along a gauge bar and having a passage defined therethrough, the module body formed from a metal, polymer, composite or synthetic material, or combinations thereof, and having a first hardness; and inserts positioned along the passage, the inserts each having slots configured to slideably receive at least a portion of one of the gauge parts therein;

wherein the inserts comprise a metal or metal carbide material having a second hardness greater than the first hardness of module body.

6. The tufting machine of claim 1, wherein each linkage comprises a cable, wire, rod, or belt, and includes a first end extending through the spring plate and connected to the second end of one of the connectors and a second end coupled to its associated actuator; wherein to retract the selected gauge parts, the one or more actuators retract the linkages coupled to the selected gauge parts such that the selected gauge parts are moved in along the second direction toward a retracted position, causing compression of at least one biasing member; and wherein to extend the selected gauge parts, the at least one biasing member is enabled to decompress and urge the selected gauge parts toward their extended positions.

7. The tufting machine of claim 1, wherein the actuators comprise motors, and wherein each linkage comprises a cable, wire, rod or belt having a first end portion adapted to connect to one of the connectors, and a second end portion coupled to one of the motors.

8. The tufting machine of claim 1, wherein the actuators comprise motors and the linkages comprise cables, wires, rods, belts, arms, or combinations thereof.

9. The tufting machine of claim 1, wherein the actuators comprise motors, each motor including a drive member coupled thereto and drive by the motor in a rotary motion; and wherein the linkages are coupled to the drive member of one of the motors such that as the drive member is rotated by the motor, the linkage is extended or retracted.

10. The tufting machine of claim 9, wherein each of the linkages comprises a first arm or rod having a first end coupled to the drive member of the motor and a second end coupled to a second arm or rod at a first end thereof, the second arm having a second end pivotally connected to the first portion of the body of one of the gauge parts; and wherein as the drive member is rotated by its motor, the first arm is extended or retracted along a first axis of movement, causing the second arm to pivot and move the one of the gauge parts between its extended and retracted positions.

11. The tufting machine of claim 1, wherein each linkage comprises an extension piece connected to or integrated with the first portion of the body of a corresponding gauge part.

12. The tufting machine of claim 1, wherein the at least one needle bar comprises a pair of needle bars each having a series of needles mounted in spaced series therealong.

13. A tufting machine, comprising:

at least one needle bar having a plurality of needles mounted therealong, the at least one needle bar moving in a reciprocating motion so as to move the plurality of needles into and out of a backing passing therebelow;

at least one yarn feed mechanism feeding yarns to the needles; and a gauge part assembly positioned below the backing, the gauge part assembly comprising:

a plurality of modules, each module including a module body having a passage defined therethrough, and one or more inserts mounted to the module body along the passage defined through the module body;

a series of gauge parts slidably received within the passages of each of the modules, the gauge parts each having a throat, wherein the gauge parts are carried with their modules in a first direction toward and away from engagement with needles of the tufting machine so as to selectively to pick up loops of yarns from the needles along the throats of the gauge parts, and are selectively movable in a second direction through the passages of their modules; and a drive system, comprising:

a plurality of actuators coupled to the gauge parts; and a series of connector assemblies configured to connect the gauge parts to the actuators, each of the connector assemblies including a connector engaging a portion of a gauge part, and at least one linkage coupled to each connector and an actuator; and a control system including programming for controlling the at least one yarn feed mechanism to control feeding of the yarns to the needles in coordination with control of actuation of one or more actuators to cause retraction or extension of the linkages coupled thereto so as to move selected ones of the gauge parts between at least one extended position for engaging and picking loops of yarns from the needles and a retracted position to substantially avoid picking loops of yarns from the needles for selectively forming tufts of yarns in the backing according to a pattern being formed;

wherein the actuators comprise motors, each having a drive member coupled thereto and to a linkage connected to a corresponding gauge part;

wherein the linkage is adapted to translate a rotary motion of the drive member by its motor to a linear motion for moving the corresponding gauge part in the second direction; and wherein the linkages comprise cables, rods, arms, wires, belts, or combinations thereof.

14. The tufting machine of claim 13, wherein the connector assemblies further comprise at least one biasing member located between each connector and a spring plate; and wherein each linkage comprises a first end extending through the spring plate and connected to the connector and a second end coupled to a drive member of a motor; wherein upon actuation, retraction of the at least one linkage causes the connector and the corresponding gauge part to be moved toward a retracted position and against the biasing member; and wherein upon release or extension of the at least one linkage, the biasing member urges the corresponding gauge part toward its at least one extended position.

15. The tufting machine of claim 13, further comprising one or more biasing members positioned between the each connector and a spring plate; and wherein actuation of a selected one of the motors causes each linkage associated therewith to retract the connector coupled thereto and move the corresponding gauge part toward a retracted position, compressing the one or more biasing members; and wherein as the one or more biasing members decompress, the corresponding gauge part is moved toward its at least one extended position.

16. The tufting machine of claim 13, wherein each linkage comprises an extension piece connected to or integrated with a corresponding gauge part.

17. The tufting machine of claim 13, wherein the modules further comprise inserts arranged on opposite sides of the passage of each module, wherein each insert has a hardness greater than a hardness of module body and includes a series of slots in which the gauge parts are received.

18. The tufting machine of claim 17, wherein the module body of each module is machined, molded or cast from a metal or composite material, and wherein the inserts each comprise a body machined, molded or cast from a metal, carbide or powdered metal material, with a tab or flange portion in which the slots are formed.

19. A tufting machine for forming tufts of yarns in a backing, comprising:

at least one needle bar having a plurality of needles mounted therealong;

at least one yarn feed mechanism feeding the yarns to the needles;

a plurality of gauge parts located below the backing, at least some of the gauge parts being moveable in a first direction toward the needles and in a second direction substantially parallel to a stroke of the needles;

a drive system coupled to the gauge parts in their second direction and comprising:

a plurality of actuators; and connector assemblies connecting the gauge parts to the actuators, each of the connector assemblies including a connector configured to connect to each gauge part and linked to at least one actuator, and one or more biasing members adjacent each connector, each biasing member configured to apply a biasing force against at least one connector; and a control system including programming for controlling the at least one yarn feed mechanism to control feeding of the yarns to the needles in coordination with actuation of one or more of selected actuators so as to move selected gauge parts associated therewith along the second direction between a no-sew position and at least one extended position with respect to the stroke of the needles into the backing for engaging the needles and forming tufts of yarns in the backing according to a pattern being formed;

wherein actuation of the one or more selected actuators causes the connector linked thereto to move the selected gauge parts toward a retracted position and against the biasing force applied thereto by the one or more biasing members; and upon deactivation of the one or more selected actuators, the one or more biasing members urge the selected gauge parts toward their at least one extended position.

20. The tufting machine of claim 19, further comprising at least one module is which at least some of the gauge parts are mounted; the at least one module comprising:

a module body adapted to mount along a gauge bar and having a passage defined therethrough, wherein the module body is formed from a metal, polymer, composite or synthetic material, or combinations thereof, and having a first hardness; and inserts positioned along the passage, the inserts each having slots configured to slidably receive at least a portion of one of the gauge parts therein;

wherein the inserts comprise a metal or metal carbide material having a second hardness greater than the first hardness of module body.

21. The tufting machine of claim 19, wherein the drive system further comprises at least one linkage extending between each of the connectors and an actuator associated therewith; wherein each of the connectors comprise a body having a first end in which a first end of a corresponding gauge part is received, and a second end connected to the at least one linkage; and wherein the one or more biasing members of each connector assembly are located between the second end of each connector and a spring plate.

22. The tufting machine of claim 21, wherein the actuators comprise motors, and wherein each linkage comprises a cable, wire, rod or belt, and includes a first end adapted to connect to one of the connectors and a second end coupled to one of the motors.

23. The tufting machine of claim 19, wherein the actuators comprise hydraulic cylinders, pneumatic cylinders, stepper motors, servo motors, electric cylinders, linear actuators, moving coil or voice coil actuators, solenoids, or combinations thereof; and further comprising at least one linkage coupled between each connector and an actuator associated therewith.

24. The tufting machine of claim 23, wherein the at least one linkage comprises a cable, wire, rod, or belt, and includes a first end extending through a plate positioned adjacent the actuators and coupled to one of the connectors and a second end coupled to the associated actuator; wherein to retract the selected gauge parts, the associated actuators retract the at least one linkage coupled to each of the selected gauge parts such that the selected gauge parts are moved toward a retracted position, compressing at least one biasing member of the one or more biasing members, and wherein to extend each of the selected gauge parts, the at least one biasing member is enabled to decompress and extend the at least one linkage so as to move each of the selected gauge parts toward their extended positions.

25. The tufting machine of claim 19, wherein the actuators comprise motors, each having a drive member to which at least one linkage coupled to an associated gauge part; wherein each linkage is adapted to translate a rotary motion of the drive member by its motor to a linear motion for moving the associated gauge parts in the second direction; and wherein the linkages comprise cables, rods, arms, wires, belts, or combinations thereof.

26. The tufting machine of claim 19, further comprising a shift mechanism for shifting the at least one needle bar transversely across the backing, and wherein the control system further comprises programming to coordinate shifting of the at least one needle bar by the shift mechanism, feeding of the backing, control of the actuators coupled to the gauge parts, and control of the at least one yarn feed mechanism feeding the yarns to the needles as the needles are reciprocated into and out of the backing, so as to present a series of yarns to selected stitch locations along the backing and withdraw non-selected yarns where loops of such non-selected yarns are not picked up by one of the gauge parts, and with the backing moved through a tufting zone at an actual stitch rate that is greater than a pattern stitch rate for the pattern being formed to provide a number of retained tufts per inch of face yarns in the backing that is approximately equivalent to the pattern stitch rate.

27. The tufting machine of claim 19, wherein actuation of the one or more selected actuators causes the connector coupled thereto to move against the biasing force applied thereto by the one or more biasing members for incrementally moving the associated gauge part toward a retracted position.

28. A method of forming tufts of yarns in a backing, the method comprising:

moving a backing along a path of travel through a tufting machine;

feeding different color or type yarns to a plurality of needles as the needles are reciprocated into the backing for presentation of the yarns for pick-up by a plurality of loopers or hooks;

reciprocating the plurality of loopers or hooks toward the needles as the needles are reciprocated into the backing;

locating at least some of the plurality of loopers or hooks at retracted or extended positions so as to avoid picking up loops of yarns from the needles, or for picking up loops of yarns having one or more selected lengths for forming tufts of one or more pile heights;

at each stitch location where loops of the yarns presented are not to be picked-up from one or more selected needles by one or more loopers or hooks, moving the one or more loopers or hooks to a retracted position sufficient to avoid pick-up of a loop of yarn from the selected needle, and controlling the feeding of such yarns so as to pull back such yarns with their selected needles; and at each stitch location where loops of the yarns are presented are to be picked up by a looper or hook of the plurality of loopers or hooks, controlling the feeding of the picked-up loops of yarns to be retained at each stitch location;

wherein locating at least some of the plurality of loopers or hooks comprises controlling one or more selected actuators to incrementally retract connectors positioned between the one or more selected actuators and selected loopers or hooks in a first direction sufficient to overcome a biasing force applied against the connectors by a biasing member to move the selected loopers or hooks between a fully extended position, through one or more intermediate incremental positions and a fully retracted, no-sew position, or allowing the biasing force to urge the connectors in a second direction opposite the first direction to extend the selected loopers or hooks between their fully retracted, no-sew position, through the one or more intermediate incremental positions, and to their fully extended position as needed.

29. The method of claim 28, wherein incrementally extending or retracting the selected the loopers or hooks comprises raising or lowering the selected loopers or hooks with respect to a stroke or penetration depth of the needles.

30. The method of claim 28, further comprising and shifting at least some of the needles transversely across the backing.

31. The method of claim 28, wherein moving the backing along its path of travel comprises feeding the backing at an actual stitch rate determined by increasing a desired stitch rate approximately by a number of different color or type yarns in a selected thread sequence.

32. A method of forming tufted patterned articles, comprising:

feeding a backing material along a path of travel;

reciprocating a series of needles into and out of the backing material;

as the needles are reciprocated into and out of the backing material, controlling feeding a plurality of yarns to the needles and reciprocating a series of gauge parts arranged below the backing material in a first direction toward and away from engagement with the needles for picking loops of yarns from the needles with at least some of the gauge parts;

moving selected ones of the gauge parts in a second direction substantially normal to the first direction between a no-sew position wherein a loop of yarn is not picked up and a plurality of extended positions with respect to a stroke or penetration depth of the needles to locate the gauge parts at desired elevations with respect to the needles for picking up one or more varying length of loops of selected yarns; and controlling the feeding of each of the selected yarns picked from the needles by the gauge parts for selectively forming varying pile height tufts in accordance with the pattern for forming the tufts of the selected yarns of the varying pile heights in the backing material;

controlling feeding of non-selected yarns so as pull the non-selected yarns out of the backing material or sufficiently low to hold the non-selected yarns against the backing material when a loop of a non-selected yarn is not picked up by one of the gauge parts; and wherein moving selected ones of the gauge parts in their second direction comprises controlling one or more selected actuators to incrementally retract or extend the selected ones of the gauge parts between a fully extended position, through one or more intermediate incremental positions, and a fully retracted, no-sew position.

33. The method of claim 32, further comprising shifting at least some of the needles transversely with respect to the path of travel of the backing material.

34. The method of claim 32 wherein moving selected ones of the gauge parts in their second direction further comprises retracting a connector positioned between each of the one or more selected actuators and the selected ones of the gauge parts downward against a biasing member sufficient to overcome a biasing force applied against the connector by the biasing member to move the selected ones of the gauge parts between their fully extended position, through their one or more intermediate incremental positions and to the fully retracted, no-sew position as needed, and controlling the actuators to enable the biasing force to urge the connector upward to extend the selected ones of the gauge parts between their fully retracted, no-sew position, through their one or more intermediate incremental positions, and to their fully extended position as needed.

35. The method of claim 32, further comprising threading at least some of the needles with a series of different color or type yarns in a selected thread-up sequence.

36. The method of claim 35, further comprising shifting at least some of the needles transversely with respect to the path of travel of the backing material so as to present different color or type yarns to each of a plurality of stitch locations, and wherein feeding the backing material comprises moving the backing material at an actual stitch rate determined by increasing a desired stitch rate for the patterned article by a number of different colors or types of yarns in the selected thread-up sequence.

* * * * *